US006708424B1

(12) United States Patent
Ellis, III

(10) Patent No.: US 6,708,424 B1
(45) **Date of Patent: *Mar. 23, 2004**

(54) SHOE WITH NATURALLY CONTOURED SOLE

(75) Inventor: Frampton E. Ellis, III, Arlington, VA (US)

(73) Assignee: Anatomic Research, Inc., Jasper, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/648,792

(22) Filed: Aug. 28, 2000

Related U.S. Application Data

(63) Continuation of application No. 08/479,779, filed on Jun. 7, 1995, now Pat. No. 6,115,941, which is a continuation-in-part of application No. 08/162,962, filed on Dec. 8, 1993, now Pat. No. 5,544,429, which is a continuation of application No. 07/930,469, filed on Aug. 20, 1992, now Pat. No. 5,317,819, which is a continuation of application No. 07/492,360, filed on Mar. 9, 1990, now Pat. No. 4,989,349, which is a continuation of application No. 07/239,667, filed on Sep. 2, 1988, now abandoned, which is a continuation of application No. 07/219,387, filed on Jul. 15, 1988, now abandoned.

(51) Int. Cl.[7] ..... A43B 13/12; A43B 7/14

(52) U.S. Cl. ..... 36/25 R; 36/30 R; 36/31; 36/114; 36/88

(58) Field of Search ..... 36/25 R, 114, 36/32 R, 88, 89, 14, 15, 11, 92, 93, 30 R

(56) References Cited

U.S. PATENT DOCUMENTS

| | | | |
|---|---|---|---|
| 119,894 | A | 10/1871 | Smyth |
| 193,914 | A | 8/1877 | Berry |
| 280,791 | A | 7/1883 | Brooks |
| 288,127 | A | 11/1883 | Shepard |

(List continued on next page.)

FOREIGN PATENT DOCUMENTS

| | | |
|---|---|---|
| AT | 200963 | 5/1958 |
| CA | 1 138 194 | 12/1982 |
| CA | 1 176 458 | 10/1984 |
| DE | 1 888 119 | 2/1954 |

(List continued on next page.)

OTHER PUBLICATIONS

Williams, Walking on Air, *Case Alumnus*, vol. LXVII, No. 6, Fall, 1989, pp. 4–8.

Brooks advertisement in *Runner's World*, Jun. 1989, pp. 56+.

Nigg et al., Influence of Heel Flare and Midsole Construction on Pronation, Supination, and Impact Forces for Heel-Toe Running, *International Journal of Sports Biomechanics*, 1988, 4, pp. 205–219.

Nigg et al., The influence of lateral heel flare of running shoes on pronation and impact forces, *Medicine and Science in Sports and Exercise*, vol. 19, No. 3, 1987, pp. 294–302.

Cavanagh et al., Biological Aspects of Modeling Shoe/Foot Interaction During Running, *Sports Shoes and Playing Surfaces*, 1984, pp. 24–25, 32–35, 46.

Blechschmidt, The Structure of the Calcaneal Padding, *Foot & Ankle*, vol. 2, No. 5, Mar. 1982, pp. 260–283.

(List continued on next page.)

*Primary Examiner*—M. D. Patterson
(74) *Attorney, Agent, or Firm*—Knoble & Yoshida, LLC

(57) ABSTRACT

A construction for a shoe, particularly an athletic shoe such as a running shoe, includes a sole that conforms to the natural shape of the foot, particularly the sides, and that has a constant thickness in frontal plane cross sections. The thickness of the shoe sole side contour equals and therefore varies exactly as the thickness of the load-bearing sole portion varies due to heel lift, for example. Thus, the outer contour of the edge portion of the sole has at least a portion which lies along a theoretically ideal stability plane for providing natural stability and efficient motion of the shoe and foot particularly in an inverted and everted mode.

38 Claims, 19 Drawing Sheets

U.S. PATENT DOCUMENTS 500,385 A 6/1893 Hall
532,429 A 1/1895 Rogers
584,373 A 6/1897 Kuhn
1,283,335 A 10/1918 Shillcock
1,289,106 A 12/1918 Bullock
D55,115 S 5/1920 Barney
1,458,446 A 6/1923 Shaeffer
1,622,860 A 3/1927 Cutler
1,639,381 A 8/1927 Manelas
1,701,260 A 2/1929 Fischer
1,735,986 A 11/1929 Wray
1,853,034 A 4/1932 Bradley
1,870,751 A 8/1932 Reach
2,120,987 A 6/1938 Murray
2,124,986 A 7/1938 Pipes
2,147,197 A 2/1939 Glidden
2,155,166 A 4/1939 Kraft
2,162,912 A 6/1939 Craver
2,170,652 A 8/1939 Brennan
2,179,942 A 11/1939 Lyne
D119,894 S 4/1940 Sherman
2,201,300 A 5/1940 Prue
2,206,860 A 7/1940 Sperry
D122,131 S 8/1940 Sanner
D128,817 S 8/1941 Esterson
2,251,468 A 8/1941 Smith
2,328,242 A 8/1943 Witherill
2,345,831 A 4/1944 Pierson
2,433,329 A 12/1947 Adler et al.
2,434,770 A 1/1948 Lutey
2,470,200 A 5/1949 Wallach
2,627,676 A 2/1953 Hack
2,718,715 A 9/1955 Spilman
2,814,133 A 11/1957 Herbst
3,005,272 A 10/1961 Shelare et al.
3,100,354 A 8/1963 Lombard et al.
3,110,971 A 11/1963 Chang
3,305,947 A 2/1967 Kalsoy
3,308,560 A 3/1967 Jones
3,416,174 A 12/1968 Novitske
3,512,274 A 5/1970 McGrath
3,535,799 A 10/1970 Onitsuka
3,806,974 A 4/1974 DiPaolo
3,824,716 A 7/1974 DiPaolo
3,863,366 A 2/1975 Auberry
3,958,291 A 5/1976 Spier
3,964,181 A 6/1976 Holcombe, Jr.
3,997,984 A 12/1976 Hayward
4,003,145 A 1/1977 Liebscher et al.
4,030,213 A * 6/1977 Daswick ..... 36/114
4,043,058 A 8/1977 Hollister et al.
4,068,395 A 1/1978 Senter
4,083,125 A 4/1978 Benseler et al.
4,096,649 A 6/1978 Saurwein
4,098,011 A 7/1978 Bowerman et al.
4,128,950 A 12/1978 Bowerman et al.
4,128,951 A 12/1978 Tansill
4,141,158 A 2/1979 Benseler et al.
4,145,785 A 3/1979 Lacey
4,149,324 A 4/1979 Lesser et al.
4,161,828 A 7/1979 Benseler et al.
4,161,829 A 7/1979 Wayser
4,170,078 A 10/1979 Moss
4,183,156 A 1/1980 Rudy
4,194,310 A 3/1980 Bowerman
D256,180 S 8/1980 Turner
D256,400 S 8/1980 Famolare, Jr.
4,217,705 A 8/1980 Donzis
4,219,945 A 9/1980 Rudy
4,223,457 A 9/1980 Borgeas
4,227,320 A 10/1980 Borgeas
4,235,026 A 11/1980 Plagenhoef
4,237,627 A 12/1980 Turner
4,240,214 A 12/1980 Sigle et al.
4,241,523 A 12/1980 Daswick
4,245,406 A 1/1981 Landay et al.
4,250,638 A 2/1981 Linnemann
4,258,480 A 3/1981 Famolare, Jr.
4,259,792 A * 4/1981 Halberstadt ..... 36/30 R
4,262,433 A 4/1981 Hagg et al.
4,263,728 A 4/1981 Frecentese
4,266,349 A 5/1981 Schmohl
4,268,980 A 5/1981 Gudas
4,271,606 A 6/1981 Rudy
4,272,858 A * 6/1981 Hlustik ..... 36/11
4,274,211 A 6/1981 Funck
4,297,797 A 11/1981 Meyers
4,302,892 A 12/1981 Adamik
4,305,212 A 12/1981 Coomer
4,308,671 A * 1/1982 Bretschneider ..... 36/11
4,309,832 A 1/1982 Hunt
4,314,413 A 2/1982 Dassier
4,316,332 A 2/1982 Giese et al.
4,316,335 A 2/1982 Giese et al.
4,319,412 A 3/1982 Muller et al.
D264,017 S 4/1982 Turner
4,322,895 A 4/1982 Hockerson
D265,019 S 6/1982 Vermonet
4,335,529 A 6/1982 Badalamenti
4,340,626 A 7/1982 Rudy
4,342,161 A 8/1982 Schmohl
4,348,821 A * 9/1982 Daswick ..... 36/32 R
4,354,319 A 10/1982 Block et al.
4,361,971 A 12/1982 Bowerman
4,364,188 A 12/1982 Turner et al.
4,366,634 A 1/1983 Giese et al.
4,370,817 A 2/1983 Ratanangsu
4,372,059 A 2/1983 Ambrose
4,398,357 A 8/1983 Batra
4,399,620 A 8/1983 Funck
D272,294 S 1/1984 Watanabe
4,435,910 A 3/1984 Marc
4,449,306 A 5/1984 Cavanagh
4,451,994 A 6/1984 Fowler
4,454,662 A 6/1984 Stubblefield
4,455,765 A 6/1984 Sjöwärd
4,455,767 A 6/1984 Bergmans
4,468,870 A 9/1984 Sternberg
4,484,397 A 11/1984 Curley, Jr.
4,494,321 A 1/1985 Lawlor
4,505,055 A 3/1985 Bergmans
4,506,462 A 3/1985 Cavanagh
4,521,979 A 6/1985 Blaser
4,527,345 A 7/1985 Lopez Lopez
D280,568 S 9/1985 Stubblefield
4,542,598 A 9/1985 Misevich et al.
4,546,559 A 10/1985 Dassler
4,550,510 A 11/1985 Stubblefield
4,557,059 A 12/1985 Misevich et al.
4,559,723 A * 12/1985 Hamy et al. ..... 36/114
4,559,724 A 12/1985 Norton
4,561,195 A 12/1985 Onoda et al.
4,577,417 A 3/1986 Cole
4,578,882 A 4/1986 Talarico, II
4,580,359 A 4/1986 Kurrash et al.
4,624,061 A 11/1986 Wezel et al.
4,624,062 A 11/1986 Autry
4,641,438 A 2/1987 Laird et al.
4,642,917 A 2/1987 Ungar
4,651,445 A 3/1987 Hannibal
D289,341 S 4/1987 Turner

| | | | | | |
|---|---|---|---|---|---|
| 4,670,995 | A | | 6/1987 | Huang | |
| 4,676,010 | A | | 6/1987 | Cheskin | |
| 4,694,591 | A | | 9/1987 | Banich et al. | |
| 4,697,361 | A | | 10/1987 | Ganter et al. | |
| D293,275 | S | | 12/1987 | Bua | |
| 4,715,133 | A | | 12/1987 | Hartjes et al. | |
| 4,722,677 | A | | 2/1988 | Rebers | |
| 4,724,622 | A | | 2/1988 | Mills | |
| D294,425 | S | | 3/1988 | Le | |
| 4,727,660 | A | | 3/1988 | Bernhard | |
| 4,730,402 | A | | 3/1988 | Norton et al. | |
| 4,731,939 | A | | 3/1988 | Parracho et al. | |
| 4,747,220 | A | | 5/1988 | Autry et al. | |
| D296,149 | S | | 6/1988 | Diaz | |
| D296,152 | S | | 6/1988 | Selbiger | |
| 4,748,753 | A | * | 6/1988 | Ju | 36/127 |
| 4,754,561 | A | | 7/1988 | Dufour | |
| 4,756,098 | A | | 7/1988 | Boggia | |
| 4,757,620 | A | | 7/1988 | Tiitola | |
| 4,759,136 | A | | 7/1988 | Stewart et al. | |
| 4,768,295 | A | | 9/1988 | Ito | |
| 4,769,926 | A | | 9/1988 | Meyers | |
| D298,684 | S | | 11/1988 | Pitchford | |
| 4,785,557 | A | | 11/1988 | Kelley et al. | |
| 4,817,304 | A | | 4/1989 | Parker et al. | |
| 4,827,631 | A | * | 5/1989 | Thornton | 36/102 |
| 4,833,795 | A | | 5/1989 | Diaz | |
| 4,837,949 | A | | 6/1989 | Dufour | |
| D302,900 | S | | 8/1989 | Kolman et al. | |
| 4,854,057 | A | | 8/1989 | Misevich et al. | |
| 4,858,340 | A | | 8/1989 | Pasternak | |
| 4,866,861 | A | | 9/1989 | Noone | |
| 4,876,807 | A | | 10/1989 | Tiitola et al. | |
| 4,890,398 | A | | 1/1990 | Thomasson | |
| 4,894,933 | A | | 1/1990 | Tonkel et al. | |
| 4,897,936 | A | | 2/1990 | Fuerst | |
| 4,906,502 | A | | 3/1990 | Rudy | |
| 4,918,841 | A | | 4/1990 | Turner et al. | |
| 4,922,631 | A | | 5/1990 | Anderie | |
| 4,934,070 | A | | 6/1990 | Mauger | |
| 4,934,073 | A | | 6/1990 | Robinson | |
| D310,131 | S | | 8/1990 | Hase | |
| D310,132 | S | | 8/1990 | Hase | |
| 4,947,560 | A | | 8/1990 | Fuerst et al. | |
| 4,949,476 | A | | 8/1990 | Anderie | |
| D310,906 | S | | 10/1990 | Hase | |
| 4,982,737 | A | | 1/1991 | Guttmann | |
| 4,989,349 | A | | 2/1991 | Ellis, III | |
| D315,634 | S | | 3/1991 | Yung-Mao | |
| 5,010,662 | A | | 4/1991 | Dabuzhsky et al. | |
| 5,014,449 | A | | 5/1991 | Richard et al. | |
| 5,024,007 | A | | 6/1991 | DuFour | |
| 5,025,573 | A | | 6/1991 | Giese et al. | |
| D320,302 | S | | 10/1991 | Kiyosawa | |
| 5,052,130 | A | | 10/1991 | Barry et al. | |
| 5,077,916 | A | | 1/1992 | Beneteau | |
| 5,079,856 | A | | 1/1992 | Truelsen | |
| 5,092,060 | A | | 3/1992 | Frachey et al. | |
| D327,164 | S | | 6/1992 | Hatfield | |
| D327,165 | S | | 6/1992 | Hatfield | |
| 5,131,173 | A | | 7/1992 | Anderie | |
| D328,968 | S | | 9/1992 | Tinker | |
| D329,528 | S | | 9/1992 | Hatfield | |
| D329,739 | S | | 9/1992 | Hatfield | |
| D330,972 | S | | 11/1992 | Hatfield et al. | |
| D332,344 | S | | 1/1993 | Hatfield et al. | |
| D332,692 | S | | 1/1993 | Hatfield et al. | |
| 5,191,727 | A | | 3/1993 | Barry et al. | |
| 5,224,280 | A | | 7/1993 | Preman et al. | |
| 5,224,810 | A | | 7/1993 | Pitkin | |
| 5,237,758 | A | | 8/1993 | Zachman | |
| D347,105 | S | | 5/1994 | Johnson | |
| 5,317,819 | A | | 6/1994 | Ellis, III | |
| 5,369,896 | A | | 12/1994 | Frachey et al. | |
| D372,114 | S | | 7/1996 | Turner et al. | |
| 5,543,194 | A | | 8/1996 | Rudy | |
| 5,544,429 | A | | 8/1996 | Ellis, III | |
| 5,572,805 | A | | 11/1996 | Giese et al. | |
| 5,575,089 | A | | 11/1996 | Giese et al. | |
| 5,628,128 | A | | 5/1997 | Miller et al. | |
| D388,594 | S | | 1/1998 | Turner et al. | |
| D409,362 | S | | 5/1999 | Turner et al. | |
| D409,826 | S | | 5/1999 | Turner et al. | |
| D410,138 | S | | 5/1999 | Turner et al. | |
| 5,909,948 | A | | 6/1999 | Ellis, III | |
| 6,115,941 | A | | 9/2000 | Ellis, III | |
| 6,115,945 | A | | 9/2000 | Ellis, III | |
| 6,163,982 | A | | 12/2000 | Ellis, III | |
| D444,293 | S | | 7/2001 | Turner et al. | |
| D450,916 | S | | 11/2001 | Turner et al. | |

FOREIGN PATENT DOCUMENTS

| | | | | |
|---|---|---|---|---|
| DE | B 23257 VII/71a | | 5/1956 | |
| DE | 1918131 | | 6/1965 | |
| DE | 1918132 | | 6/1965 | |
| DE | 1 287 477 | | 1/1969 | |
| DE | 1 290 844 | | 3/1969 | |
| DE | 2036062 | | 7/1970 | |
| DE | 1948620 | | 5/1971 | |
| DE | 1685293 | | 7/1971 | |
| DE | 1 685 260 | | 10/1971 | |
| DE | 2045430 | | 3/1972 | |
| DE | 2522127 | | 11/1976 | |
| DE | 2525613 | | 12/1976 | |
| DE | 2602310 | | 7/1977 | |
| DE | 2613312 | | 10/1977 | |
| DE | 27 06 645 | | 8/1978 | |
| DE | 2654116 | | 1/1979 | |
| DE | 27 37 765 | | 3/1979 | |
| DE | 28 05 426 | | 8/1979 | |
| DE | 3021936 | | 4/1981 | |
| DE | 30 24 587 A1 | | 1/1982 | |
| DE | 8219616.8 | | 9/1982 | |
| DE | 3113295 | | 10/1982 | |
| DE | 3245182 | * | 5/1983 | |
| DE | 33 17 462 | | 10/1983 | |
| DE | 3347343 | | 7/1985 | |
| DE | 8530136.1 | | 2/1988 | |
| DE | 36 29 245 | | 3/1988 | |
| EP | 0 048 965 | | 4/1982 | |
| EP | 0 083 449 | | 7/1983 | |
| EP | 0 130 816 | | 1/1985 | |
| EP | 0 185 781 | | 7/1986 | |
| EP | 0207063 | | 10/1986 | |
| EP | 0 206 511 | | 12/1986 | |
| EP | 0 213 257 | | 3/1987 | |
| EP | 0 215 974 | | 4/1987 | |
| EP | 0 238 995 | | 9/1987 | |
| EP | 0 260 777 | | 3/1988 | |
| EP | 0 301 331 | | 2/1989 | |
| EP | 0 329 391 | | 8/1989 | |
| EP | 0 410 087 | | 1/1991 | |
| FR | 602.501 | | 3/1926 | |
| FR | 925.961 | | 9/1947 | |
| FR | 1004472 | * | 3/1952 | 36/59 C |
| FR | 1245672 | | 10/1960 | |
| FR | 1.323.455 | | 2/1963 | |
| FR | 2.006.270 | | 10/1971 | |
| FR | 2 261 721 | | 9/1975 | |
| FR | 2 511 850 | | 3/1983 | |
| FR | 2 622 411 | | 5/1989 | |
| GB | 16143 | | of 1891 | |

| | | |
|---|---|---|
| GB | 9591 | of 1913 |
| GB | 764956 | 1/1957 |
| GB | 807305 | 1/1959 |
| GB | 1504615 | 3/1978 |
| GB | 2 023 405 | 1/1980 |
| GB | 2 039 717 | 8/1980 |
| GB | 2076633 | 12/1981 |
| GB | 2133668 | 8/1984 |
| GB | 2 136 670 | 9/1984 |
| JP | 39-15597 | 8/1964 |
| JP | 45-5154 | 3/1970 |
| JP | 50-71132 | 11/1975 |
| JP | 57-139333 | 8/1982 |
| JP | 59-23525 | 7/1984 |
| JP | 61-55810 | 4/1986 |
| JP | 1129505 | 6/1986 |
| JP | 61-167810 | 10/1986 |
| JP | 1-195803 | 8/1989 |
| JP | 2136505 | 5/1990 |
| JP | 2279103 | 11/1990 |
| JP | 3-85102 | 4/1991 |
| JP | 3086101 | 4/1991 |
| JP | 4-279102 | 10/1992 |
| JP | 5-123204 | 5/1993 |
| NZ | 189890 | 9/1981 |
| WO | WO 87/07480 | 12/1987 |
| WO | WO8707481 | 12/1987 |
| WO | WO 88/08263 | 11/1988 |
| WO | WO 89/06500 | 7/1989 |
| WO | WO 90/00358 | 1/1990 |
| WO | WO 91/00698 | 1/1991 |
| WO | WO 91/03180 | 3/1991 |
| WO | WO 91/04683 | 4/1991 |
| WO | WO 91/05491 | 5/1991 |
| WO | WO 91/10377 | 7/1991 |
| WO | WO 91/11124 | 8/1991 |
| WO | WO 91/11924 | 8/1991 |
| WO | WO 91/19429 | 12/1991 |
| WO | WO 92/07483 | 5/1992 |
| WO | WO 92/18024 | 10/1992 |
| WO | WO 93/13928 | 2/1993 |
| WO | WO 94/03080 | 2/1994 |
| WO | WO 97/00029 | 1/1997 |
| WO | WO 00/64293 | 11/2000 |

OTHER PUBLICATIONS

Cavanagh, The Running Shoe Book, © 1980, pp. 176–180, Anderson World, Inc., Mountain View, CA.
Ellis, III, *Executive Summary with seven figures*.
The Reebok Lineup, Fall 1987 (1 2–sided page).
German description of adidas badminton shoe, pre–1989?.
Originally filed specification for U.S. Patent Application SN 09/522,174, filed Mar. 9,2000 (ELL–002.5).
adidas shoe, Model <<Water Competition>> 1980.
adadas shoe, Model >>Tauern>> 1986.
Saucony Spot–bit shoe, *The Complete Handbook of Athletic Footwear*, pp 332, 1987.
Puma basketball shoe, *The Complete Handbook of Athletic Footwear*, pp 315, 1987.
adidas shoe, Model, <<Indoor Pro>> 1987.
Fineagen, "Comparison of the Effects of a Running Shoe and A Racing Flat on the Lower Extermity Biomechanical Alignment of Runners", *Journal of the American Physical Therapy Association*, vol., 68, No. 5, p 806 (1988).
Footwear Nows, Special Supplement, Feb. 8, 1988.
Nike shoe, Model <<Zoom Street Leather>> 1988.
Nike shoe, Model, <<Leather Cortex®>> 1988.
Nike shoe, Model <<Air Revolution>> #15075, 1988.
Nike Shoe, Model "Air Force" #1978, 1988.
Nike shoe, Model <<Air Flow<< #718, 1988.
Nike shoe, Model "Air" #1553, 1988.
Nike shoe, Model <<Air>>, #13213 1988.
Nike shoe, Model <<Air>>, 4183, 1988.
adidas shoe Model "Skin Racer" 1988.
adidas shoe, Model <<Tennis Comfort>> 1988.
Palamarchuk et al., "In shoe Casting Technique for Specialized Sports Shoes", *Journal of the America, Podiatric Medical Association*, vol. 79, No. 9, pp 462–465 1989.
adidas shoe, Model "Torsion Grand Slam Indoor", 1989.
adidas shoe, Model <<Torsion ZX 9020 S>> 1989.
adidas shoe, Model <<Torison Special HI>> 1989.
adidas Catalog 1990.
Johnson et al., <<A Biomechanical Approach to the Design of Football Boots>>, *Journal of Biomechanics*, vol. 9, pp. 581–585 (1976).
Fixx, *The Complete Book of Running*, pp 134–137 1977.
Romika Catalog, Summer 1978.
World Professional Squash Association Pro Tour Program, 1982–1983.
Williams et al., <<The Mechanics of Foot Action During The GoldSwing and Implications for Shoe Design>>, *Medicine and Science in Sports and Exercise*, vol. 15, No. 3, pp 247–255 1983.
Nigg et al., <<Biomechanical Aspects of Sport Shoes and Playing Surfaces>>, *Proceedings of the International Symposium on Biomechanical Aspects of Sport Shoes and Playing Surfaces*, 1983.
Valiant et al., <<A Study of Landing from a Jump: Implications for the Design of a Basketball Shoe>>, *Scientific Program of IX International Congress of Biomechanics*, 1983.
Frederick, *Sports Shoes and Playing Surfaces, Biomechanical Properties*, Entire Book, 1984.
Saucony Spot–bilt Catalog Supplement, Spring 1985.
adidas shoe, Model <<Fire>> 1985.
adidas shoe, Model <<Tolio H. >>, 1985.
adidas shoe, Model "Buffalo" 1985.
adidas shoe, Model "Marathon 86" 1985.
adidas shoe, Model <<Boston Super>> 1985.
Leuthi et al., <<Influence of Shoe Construction on Lower Extremity Kinematics and Load During Lateral Movements In Tennis>>, *International Journal of Sport Biomechanics*,, vol. 2, pp 166–174.1986.
Nigg et al., *Biomechanics of Running Shoes*, entire book, 1986.
Runner's World, Oct. 1986.
AVIA Catalog 1986.
Brooks Catalog 1986.
adidas Catalog 1986.
adidas shoe, Model <<Questar>>, 1986.
adidas shoe, Model "London" 1986.
adidas shoe, Model <<Marathon>>1986.
adidas shoe, Model <<Kingscup Indoor>>, 1986.
Komi et al., "Interaction Between Man and Shoe in Running: Considerations for More Comprehensive Measurement Approach", *International Journal of Sports Medicine*, vol. 8, pp. 196–202 1987.
Nigg et al., <<The Influence of Laternal Heel Flare of Running Shoes on Protraction and Impact Forces>>, *Medicine and Science in Sports and Excercise*, vol. 19, No. 3, pp. 294–302 1987.

Nigg, <<Biomechanical Analysis of Ankle and foot Movement>> *Medicine and Sport Science*, vol. 23, pp 22–29 1987.
*The Complete Handbook of Athletic Footwear*, Entire book, 1987.
adidas Catalog, 1987.
adidas Catalog, Spring 1987.
Nike Fall Catalog 1987, pp 50–51.
Footwear Journal, Nike Advertisement, Aug. 1987.
Sporting Goods Business, Aug. 1987.
Nigg et al., "Influence of Hell Flare and Midsole Construction on Pronation" *International Journal of Sport Biomechanics*, vol. 4, No. 3, pp. 205–219, (1987).
Vagenas et al., <<Evaluationm of Rearfoot Asymmetrics in Running With Worn and New Running Shoes<<, *International Journal of Sport Biomechanics*, vol., 4, No. 4, pp 342–357 (1988).
Nawoczenside et al., <<Effect of Rocker Sole Design on Planter Forefoot Pressures>>*Journal of the American Podiatric Medical Association*, vol. 79, No. 9, pp 455–460, 1988.
Sprts Illustrated, Special Preview Issue, The Summer Olympics <<Seoul '88>> Reebok Advertistement.
Sports Illustrated, Nike Advertisement, Aug. 8, 1988.
Runner's World, "Shoe Review" Nov. 1988 pp 46–74.
Footwear New, vol. 44, No. 37, Nike Advertisement (1988).
Saucony Spot–bilt Catalog 1988.
Runner's World, Apr. 1988.
Footwear News, Special Supplement, Feb. 8, 1988.
Kronos Catalog, 1988.
Avia Fall Catalog 1988.
Nike shoe, Model <<High Jump 88>>, 1988.
adidas Catalog 1988.
Segesser et al., "Surfing Shoe", *The Shoe in Sport*, 1989, (Translation of a book published in Germany in 1987), pp. 106–110.
Runner's World, "Spring Shoe Survey", pp. 45–74.
Footwear News, vol. 45, No. 5, Nike Advertisement 1989.
Nike Spring Catalog 1989 pp. 62–63.
Prince Cross–Sport 1989.
adidas Catalog 1989.
adidas Spring Catalog 1989.
adidas Autumn Catalog 1989.
Nike Shoe, men's cross–training Model "Air Trainer SC" 1989.
Nike shoe, men's cross–training Model <<Air Trainer TW>> 1989.
Areblad et al., <<Three–Dimensional Measurement of Rearfoot Motion During Running>> *Journal of Biomechanics*, vol. 23, pp. 933–940 (1990).
Cavanagh et al., "Biomechanics of Distance Running", Human Kinetics Books, pp 155–164 1990.
adidas Catalog 1991.
K–Swiss Catalog, Fall 1991.
Clark Shoe Designed by Sven Coomer 1991.
adidas' First Supplement Response to Interrogatory No. 1.
Complaint, Anatomic Research, Inc. and Frampton E. Ellis v. adidas America, Inc. Civil Action No. 01–1781–A.
Answer and Counterclaim of Defendant adidas America, Inc., Anatomic Research, Inc. And Frampton E. Ellis v. adidas America, Inc. Civil Action No. 01–1781–A dated Dec. 14, 1991.
Complaint, Anatomic Research, Inc. V. adidas America, Inc. Adidas Salomon North America, Inc. Adidas Sales, Inc. And adidas Promotional Retail Operations, Inc. Civil Action No. 2 :01cv960.
Answer and Counterclaim, Anatomic Research, Inc. V. adidas America, Inc. Adidas Salomon North America, Inc. Adidas Sales, Inc.And adidas Promotional Retail Oeprations, Inc. Civil Action No. 2 :01cv960 dated Jan. 14, 2002.
adidas America, Inc. v. Anatomic Research, Inc. and Frampton E. Ellis III, adidas America Inc.'s Responses to Defendants' First Set of Interrogatories dated Jan. 28, 2002.

* cited by examiner

FIG. 1
(PRIOR ART)
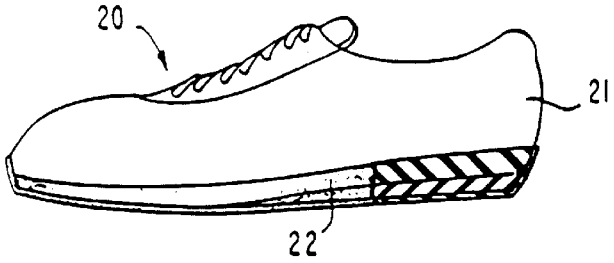
FIG. 2A
(PRIOR ART)
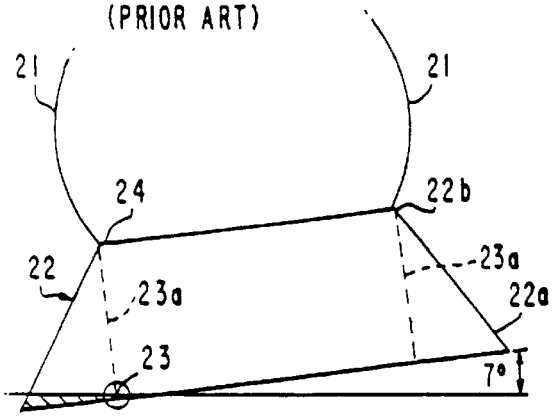
FIG. 2
FIG. 2B
(PRIOR ART)
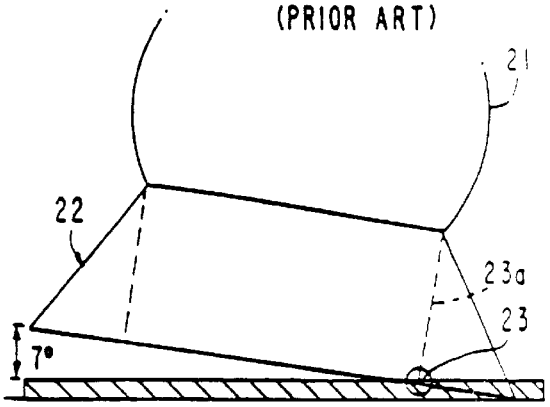
FIG. 2C
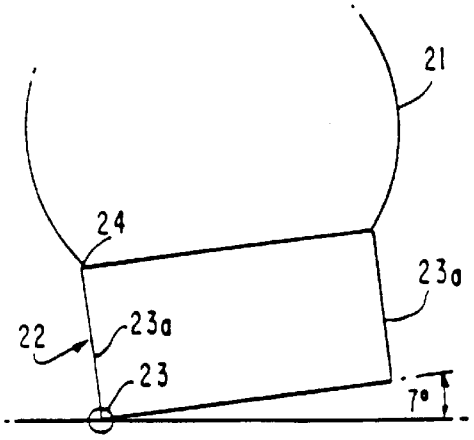
FIG. 2D
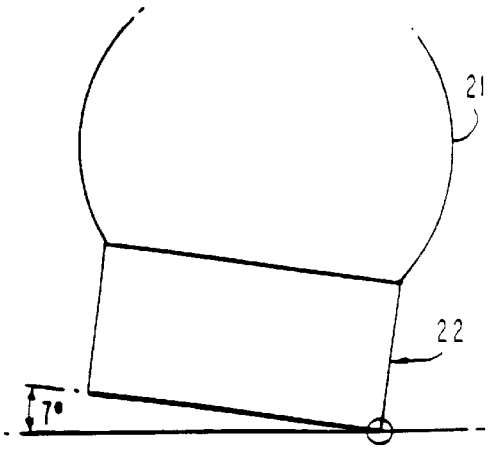

FIG. 5
FIG. 5A
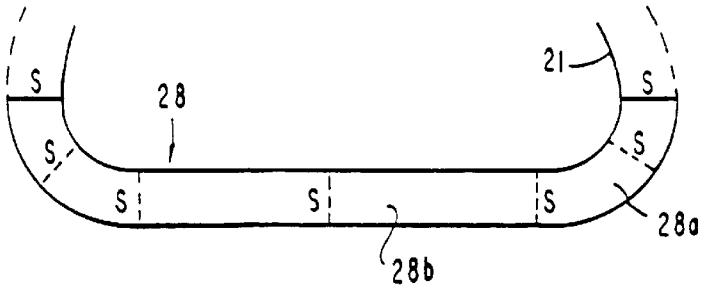
FIG. 5B
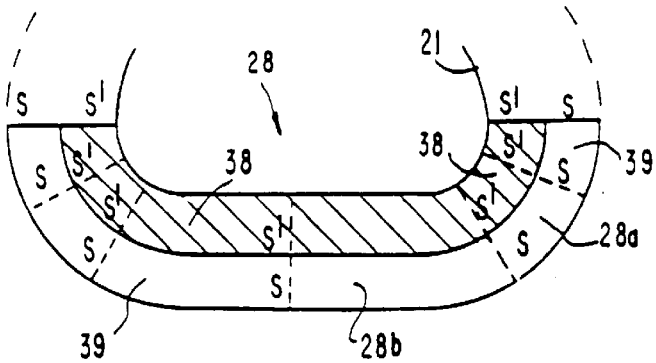
FIG. 6
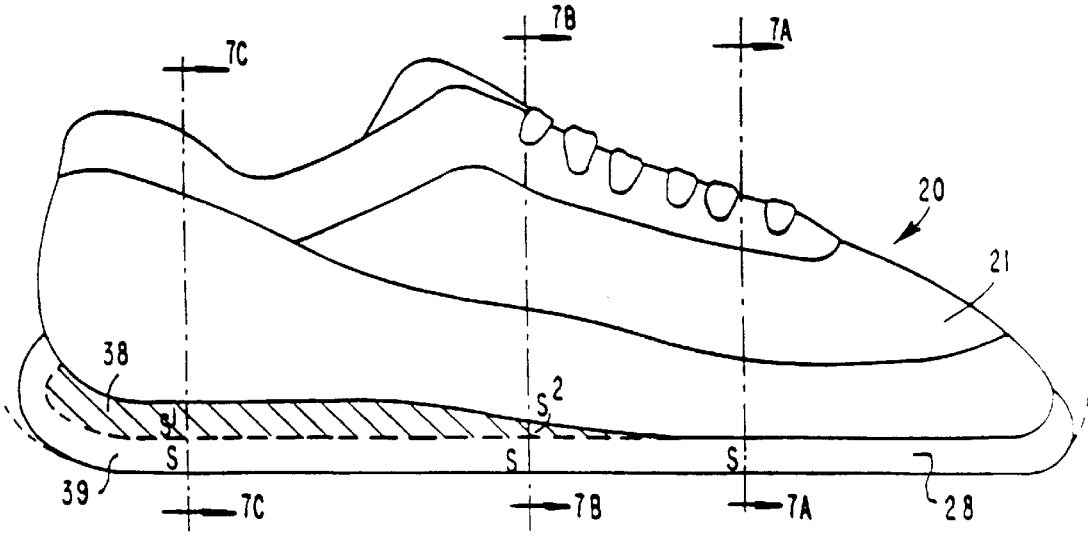

FIG. 7A
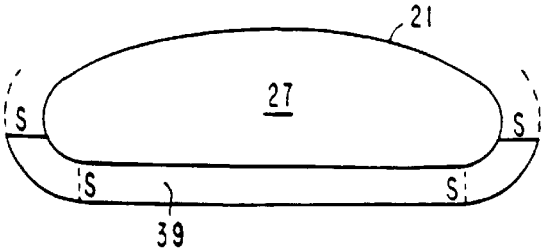
FIG. 7B
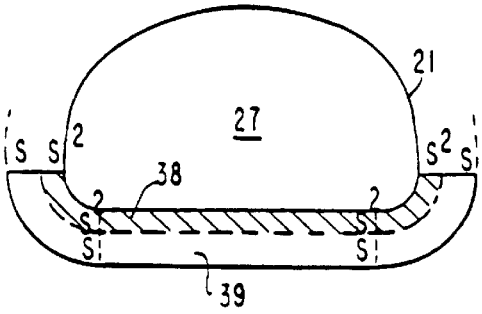
FIG. 7C
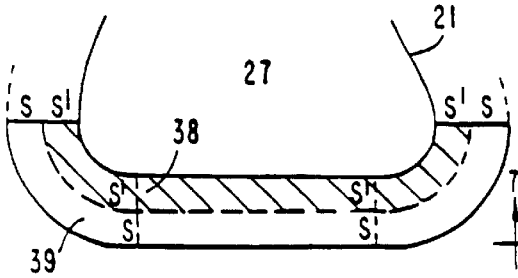
FIG. 7
FIG. 7D
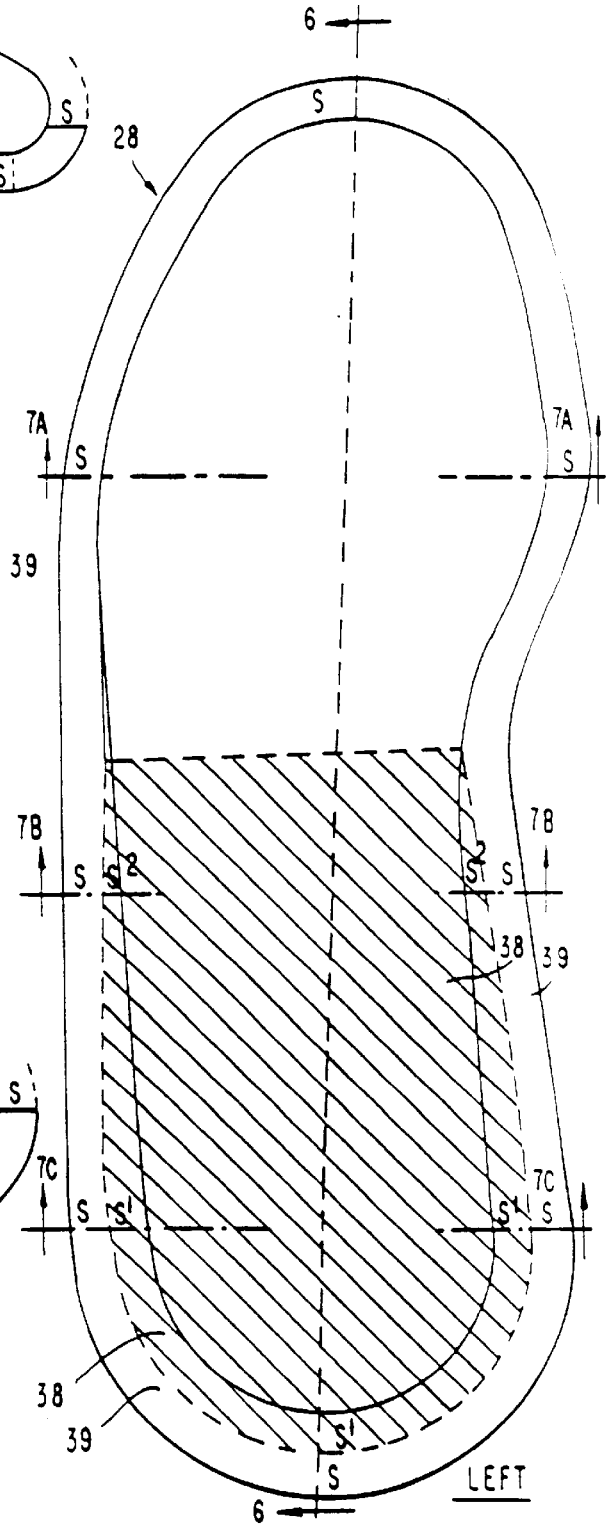

FIG. 8
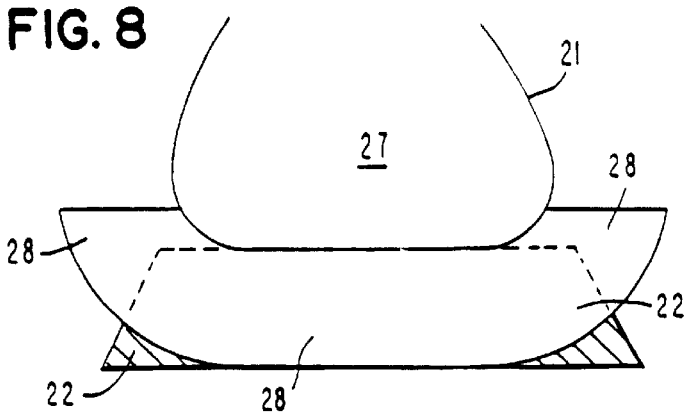
FIG. 9
FIG. 9A
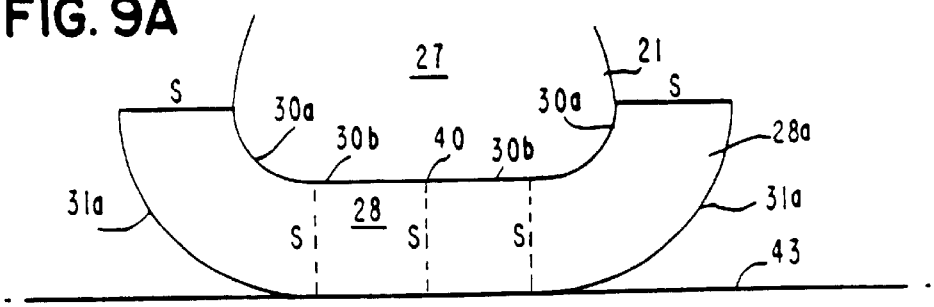
FIG. 9B
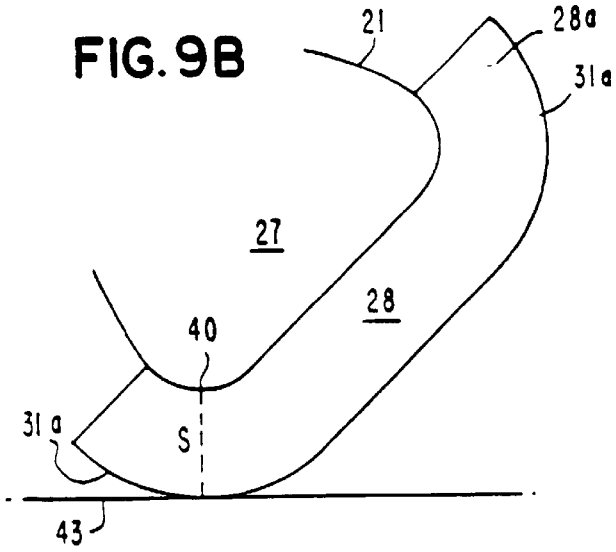
FIG. 9C
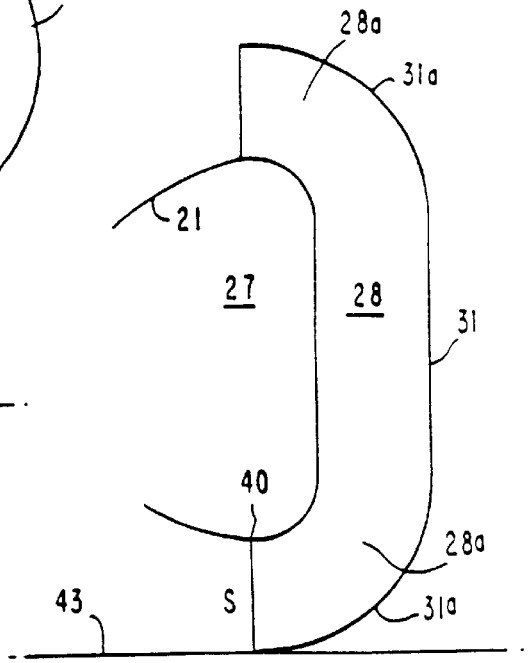

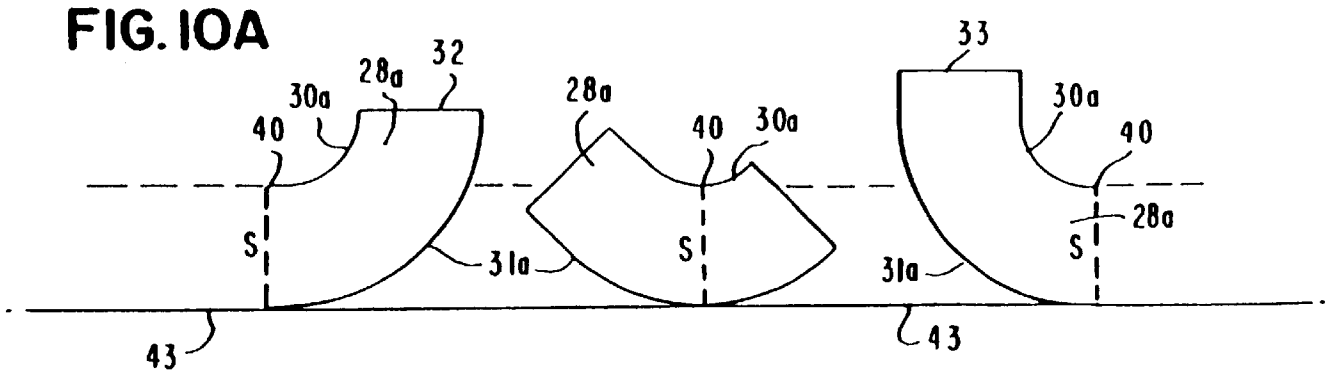
FIG. 10
FIG. 10A
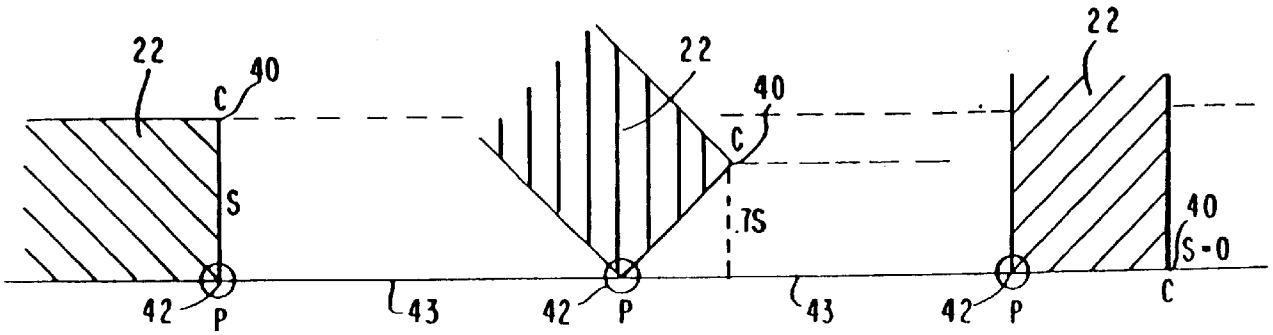
FIG. 10B

FIG. 12
FIG. 12A
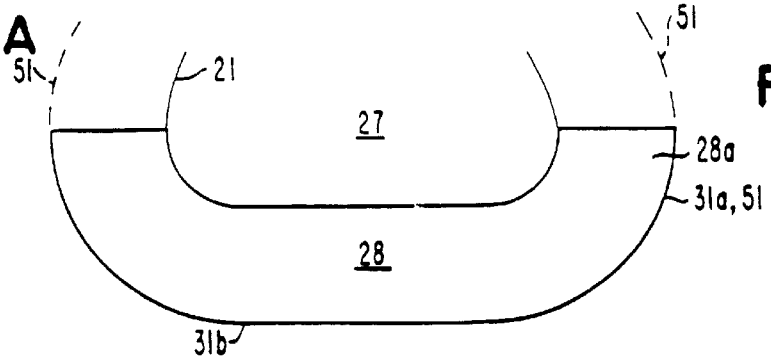
FIG. 12B
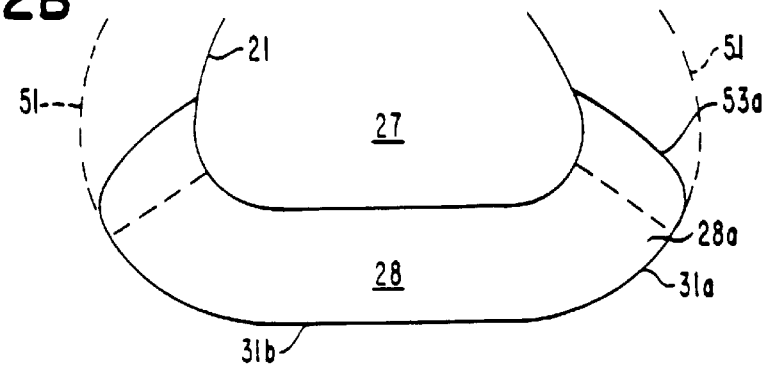
FIG. 12C
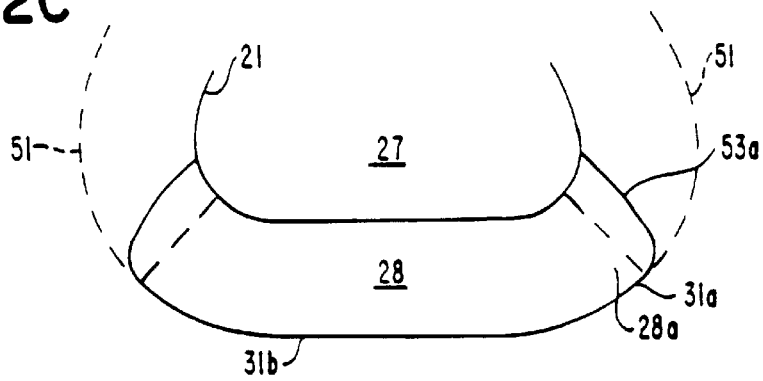
FIG. 12D
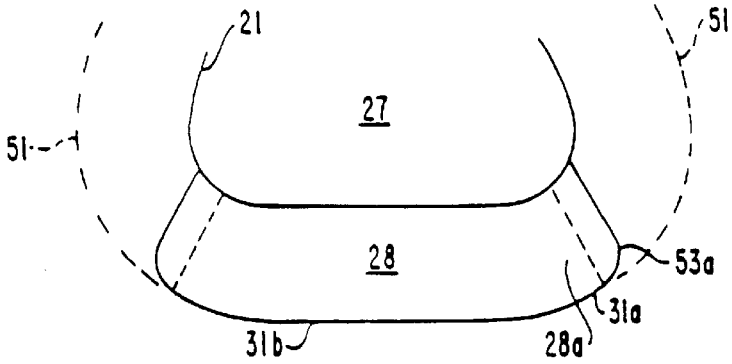

FIG. 13
FIG. 13A
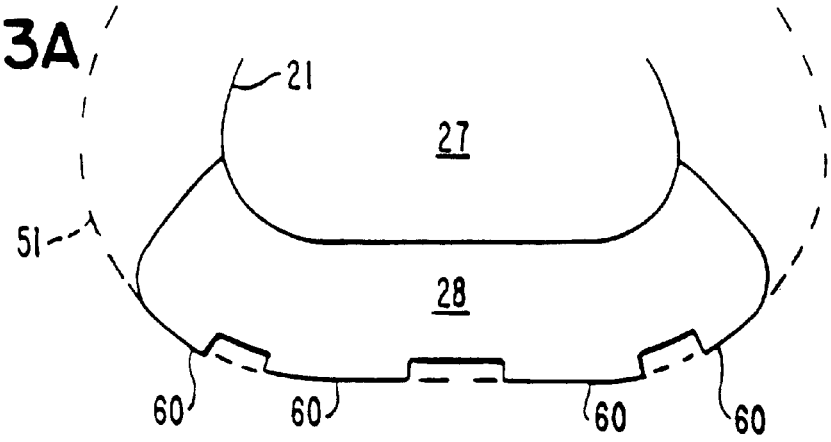
FIG. 13B
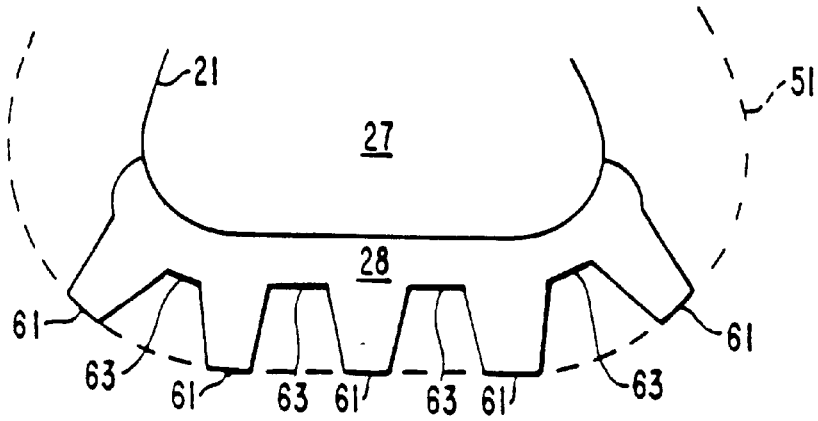
FIG. 13C
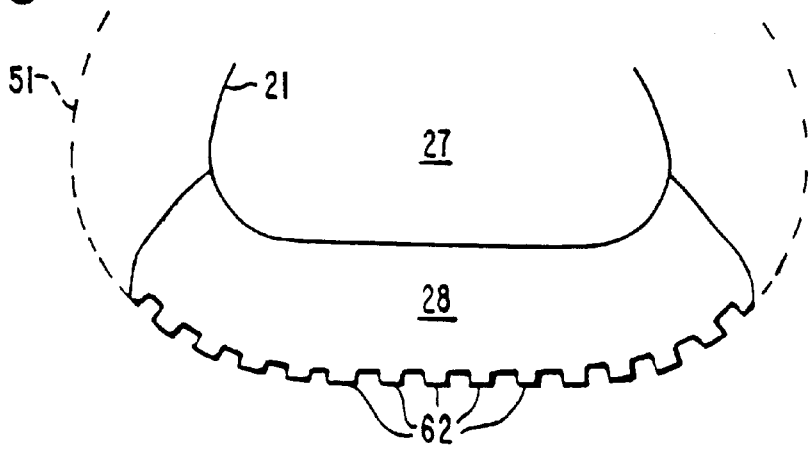

FIG. 18
FIG. 18A
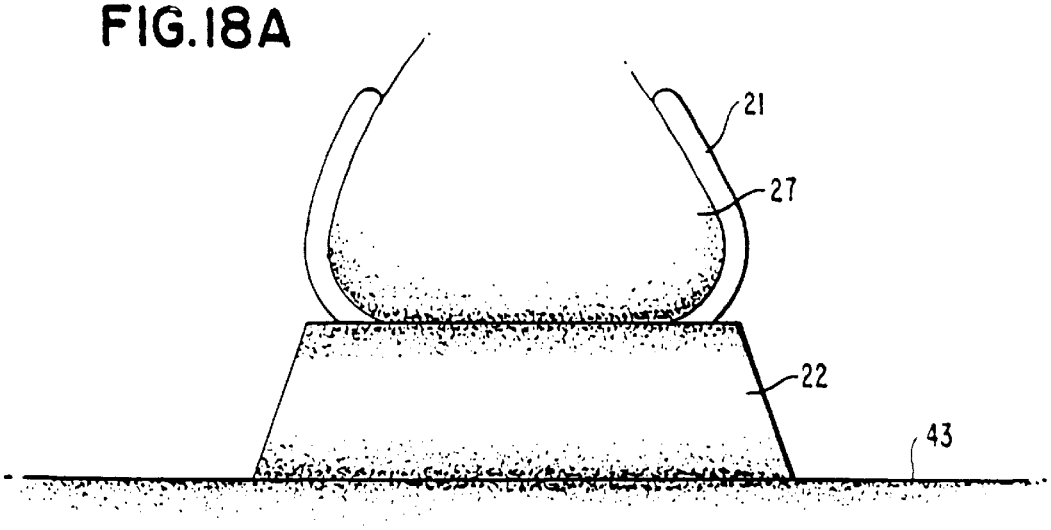
FIG. 18B
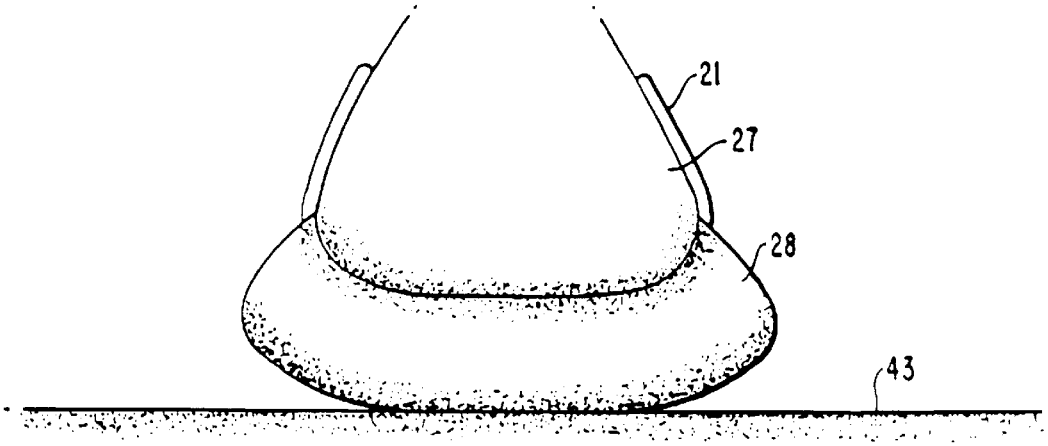

FIG. 19A
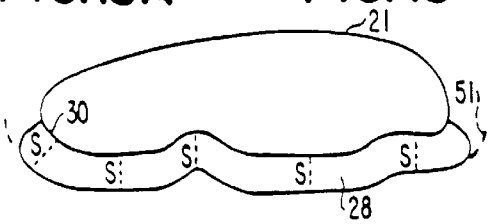
FIG. 19
FIG. 19B
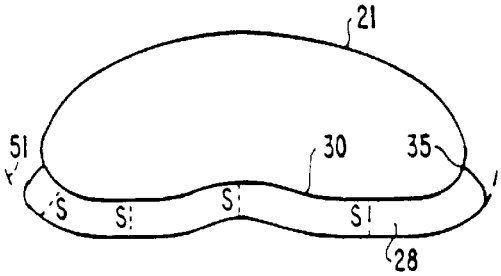
FIG. 19C
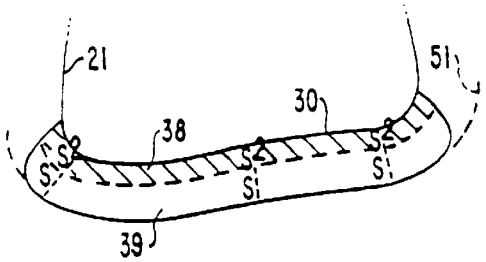
FIG. 19D
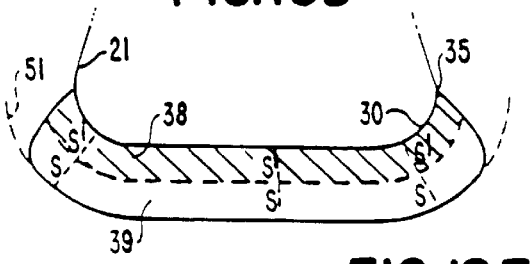
FIG. 19E
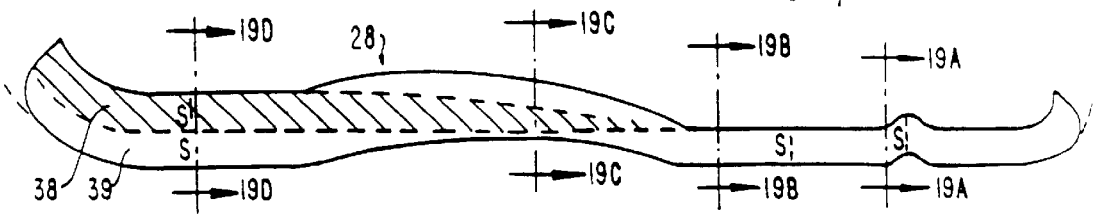
FIG. 19F
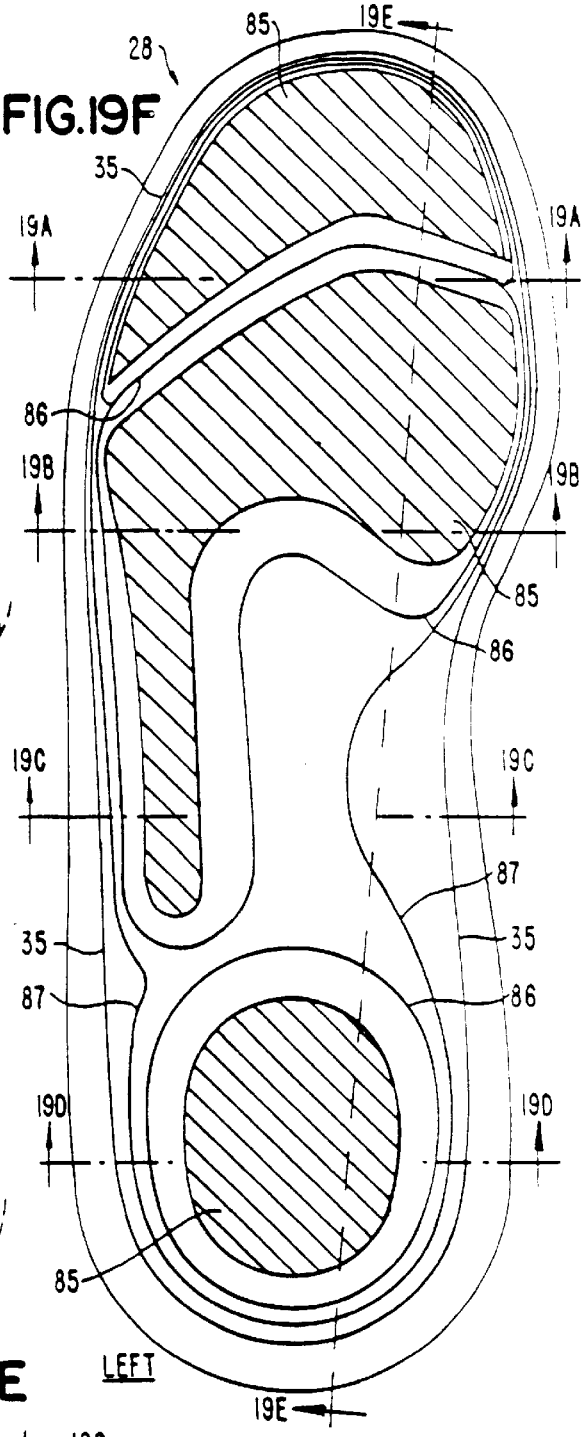

FIG. 20A
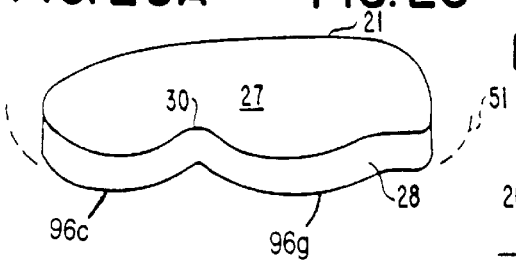
FIG. 20
FIG. 21
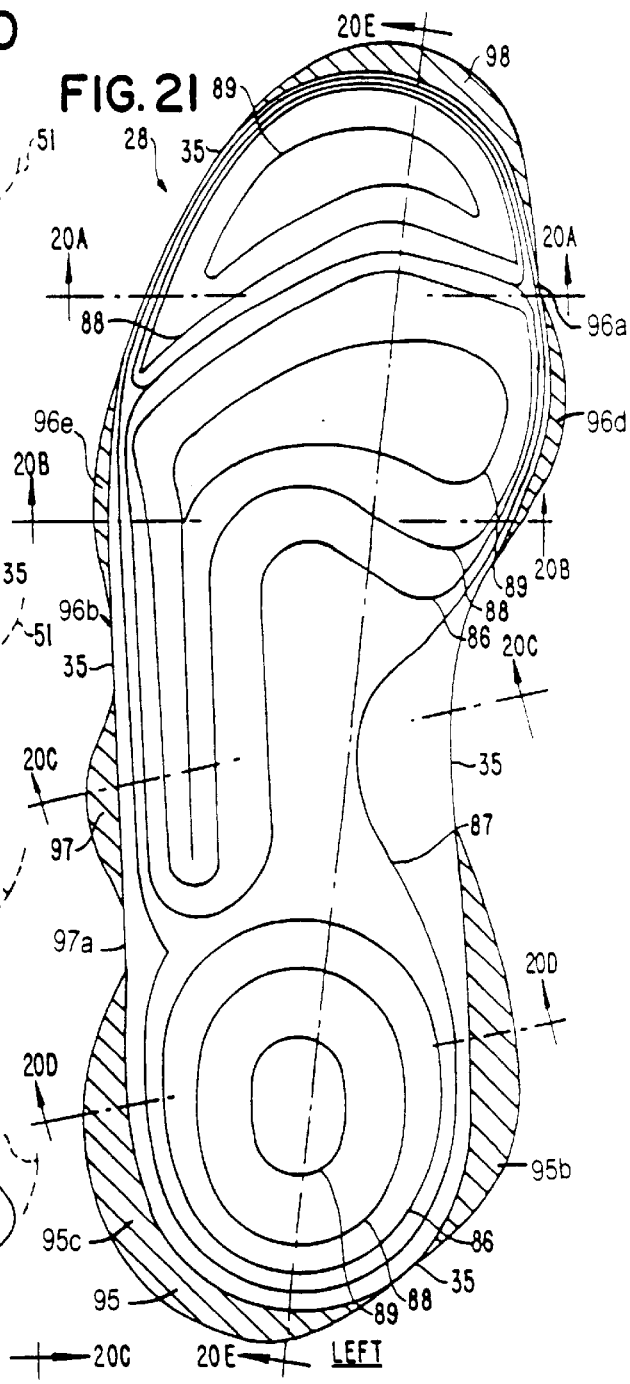
FIG. 20B
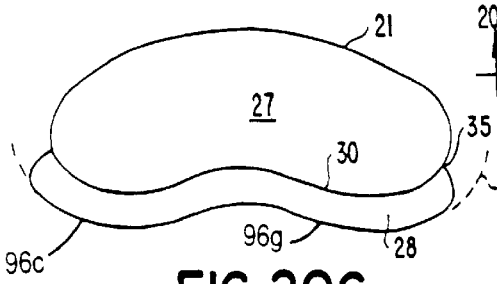
FIG. 20C
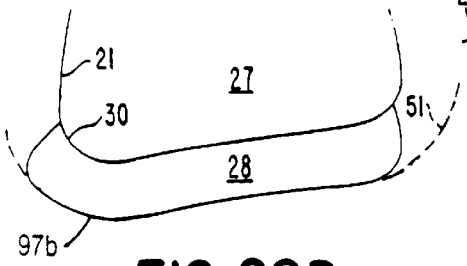
FIG. 20D
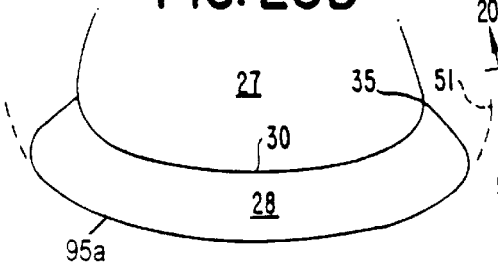
FIG. 20E
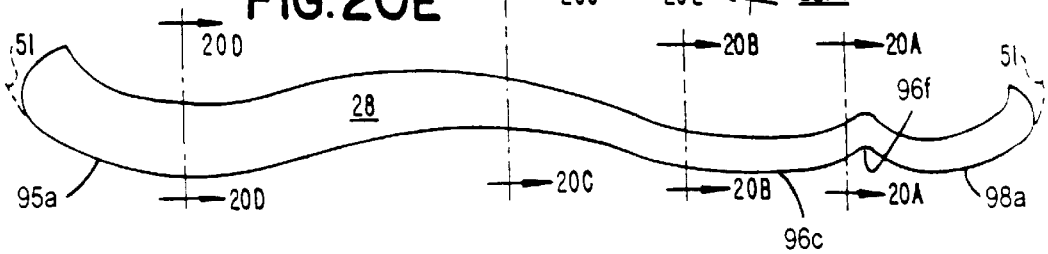

FIG. 22
FIG. 22A
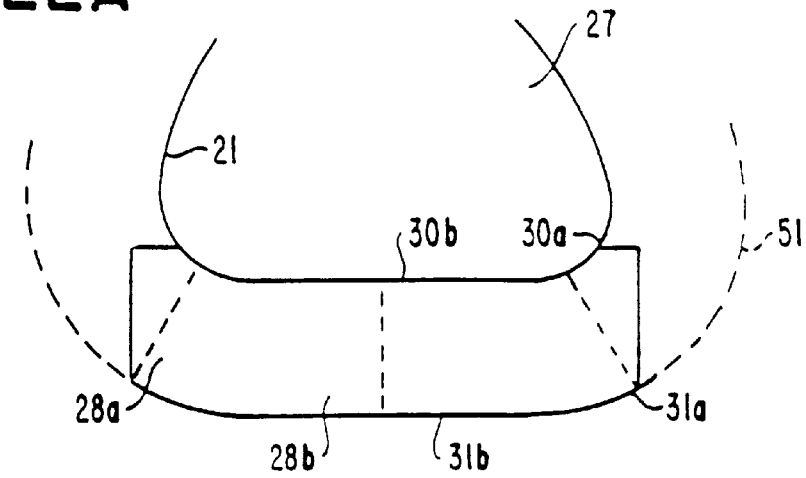
FIG. 22B
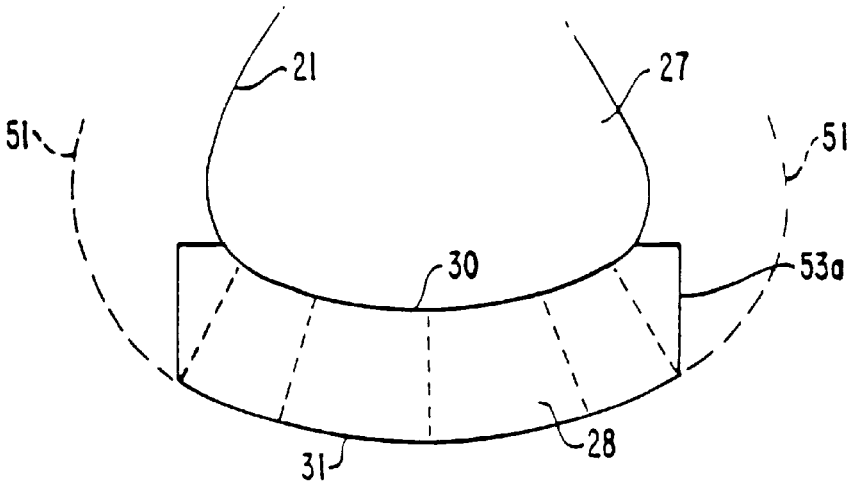

FIG. 23
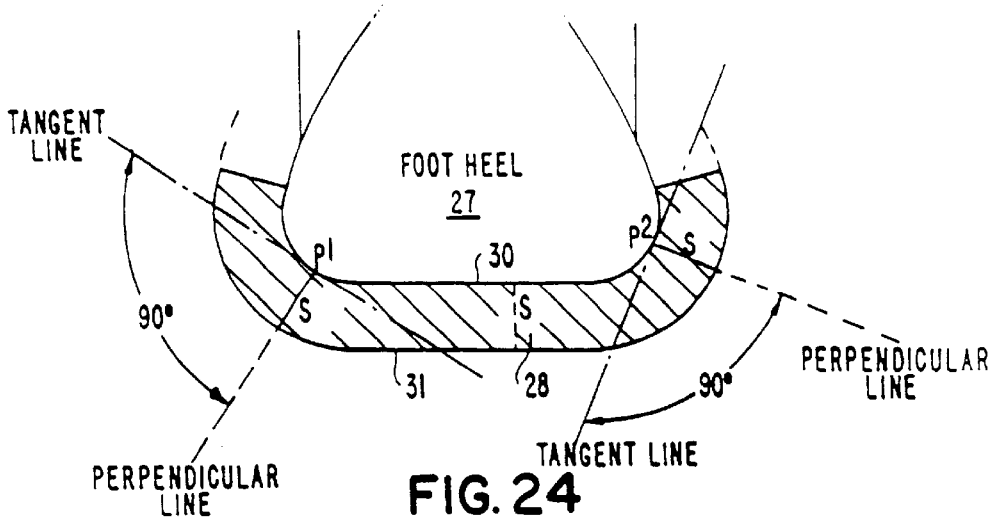
FIG. 24
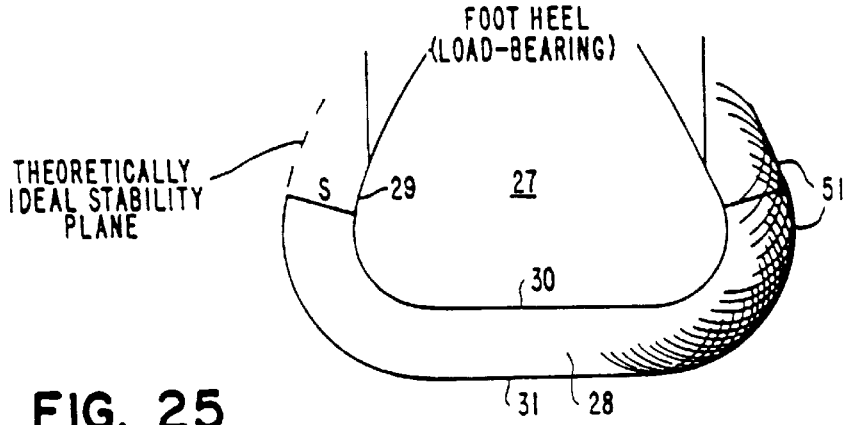
FIG. 25
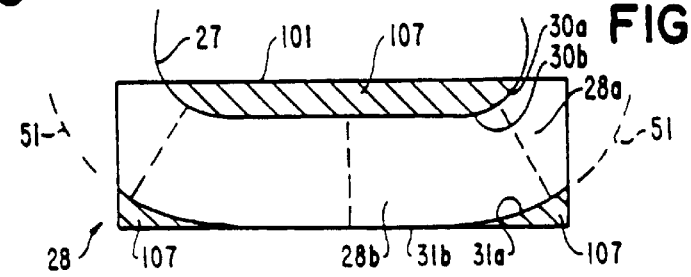
FIG. 25A
FIG. 25B
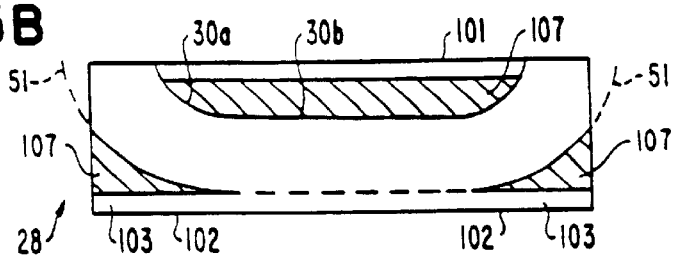

FIG. 26
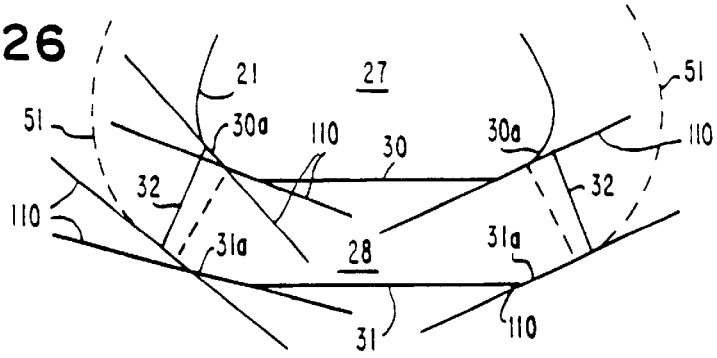
FIG. 27
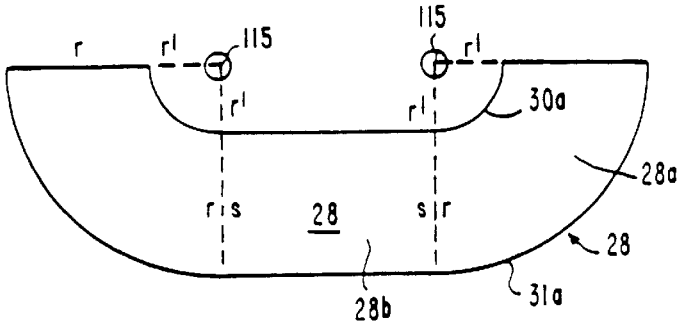
FIG. 28A
FIG. 28
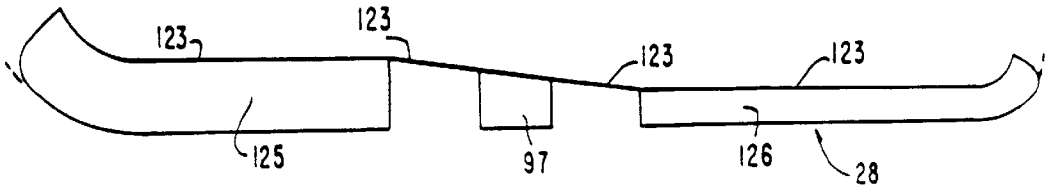
FIG. 28B
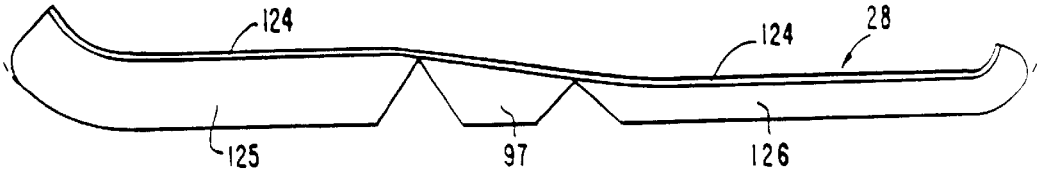

SHOE WITH NATURALLY CONTOURED SOLE

CROSS-REFERENCE TO RELATED APPLICATIONS

This application is a continuation of U.S. application Ser. No. 08/479,779, filed Jun. 7, 1995, now U.S. Pat. No. 6,115,941, which is a continuation-in-part of application Ser. No. 08/162,962 filed Dec. 8, 1993 now U.S. Pat. No. 5,544,429, which is a continuation of Ser. No. 07/930,469 filed Aug. 20, 1992, now U.S. Pat. No. 5,317,819 issued Jun. 7, 1994 which is a continuation of Ser. No. 07/239,667 filed Sep. 2, 1988, now abandoned and application Ser. No. 07/492,360, filed Mar. 9, 1990, now U.S. Pat. No. 4,989,349 issued Feb. 5, 1991 which is a continuation of Ser. No. 07/219,387, filed Jul. 15, 1988, now abandoned.

BACKGROUND OF THE INVENTION

This invention relates to a shoe, such as a street shoe, athletic shoe, and especially a running shoe with a contoured sole. More particularly, this invention relates to a novel contoured sole design for a running shoe which improves the inherent stability and efficient motion of the shod foot in a extreme exercise. Still more particularly, this invention relates to a running shoe wherein the shoe sole conforms to the natural shape of the foot, particularly the sides, and has a constant thickness in frontal plane cross sections, permitting the foot to react naturally with the ground as it would if the foot were bare, while continuing to protect and cushion the foot.

By way of introduction, barefoot populations universally have a very low incidence of running "overuse" injuries, despite very high activity levels. In contrast, such injuries are very common in shoe shod populations, even for activity levels well below "overuse". Thus, it is a continuing problem with a shod population to reduce or eliminate such injuries and to improve the cushioning and protection for the foot. It is primarily to an understanding of the reasons for such problems and to proposing a novel solution according to the invention to which this improved shoe is directed.

A wide variety of designs are available for running shoes which are intended to provide stability, but which lead to a constraint in the natural efficient motion of the foot and ankle. However, such designs which can accommodate free, flexible motion in contrast create a lack of control or stability. A popular existing shoe design incorporates an inverted, outwardly-flared shoe sole wherein the ground engaging surface is wider than the heel engaging portion. However, such shoes are unstable in extreme situations because the shoe sole, when inverted or on edge, immediately becomes supported only by the sharp bottom sole edge where the entire weight of the body, multiplied by a factor of approximately three at running peak, is concentrated. Since an unnatural lever arm and force moment are created under such conditions, the foot and ankle are destabilized and, in the extreme, beyond a certain point of rotation about the pivot point of the shoe sole edge, forceably cause ankle strain. In contrast, the unshod foot is always in stable equilibrium without a comparable lever arm or force moment and, at its maximum range of inversion motion, about 200, the base of support on the barefoot heel actually broadens substantially as the calcaneal tuberosity contacts the ground. This is in contrast to the conventionally available shoe sole bottom which maintains a sharp, unstable edge.

It is thus an overall objective of this invention to provide a novel shoe design which approximates the barefoot. It has been discovered, by investigating the most extreme range of ankle motion to near the point of ankle sprain, that the abnormal motion of an inversion ankle sprain, which is a tilting to the outside or an outward rotation of the foot, is accurately simulated while stationary. With this observation, it can be seen that the extreme range stability of the conventionally shod foot is distinctly inferior to the barefoot and that the shoe itself creates a gross instability which would otherwise not exist.

Even more important, a normal barefoot running motion, which approximately includes a 7° inversion and a 7° eversion motion, does not occur with shod feet, where a 30° inversion and eversion is common. Such a normal barefoot motion is geometrically unattainable because the average running shoe heel is approximately 60% larger than the width of the human heel. As a result, the shoe heel and the human heel cannot pivot together in a natural manner; rather, the human heel has to pivot within the shoe but is resisted from doing so by the shoe heel counter, motion control devices, and the lacing and binding of the shoe upper, as well as various types of anatomical supports interior to the shoe.

Thus, it is an overall objective to provide an improved shoe design which is not based on the inherent contradiction present in current shoe designs which make the goals of stability and efficient natural motion incompatible and even mutually exclusive. It is another overall object of the invention to provide a new contour design which simulates the natural barefoot motion in running and thus avoids the inherent contradictions in current designs.

It is another objective of this invention to provide a running shoe which overcomes the problem of the prior art.

It is another objective of this invention to provide a shoe wherein the outer extent of the flat portion of the sole of the shoe includes all of the support structures of the foot but which extends no further than the outer edge of the flat portion of the shoe sole so that the transverse or horizontal plane outline of the top of the flat portion of the shoe sole coincides as nearly as possible with the loadbearing portion of the foot sole.

It is another objective of the invention to provide a shoe having a sole which includes a side contoured like the natural form of the side or edge of the human foot and conforming to it.

It is another objective of this invention to provide a novel shoe structure in which the contoured sole includes a shoe sole thickness that is precisely constant in frontal plane cross sections, and therefore biomechanically neutral, even if the shoe sole is tilted to either side, or forward or backward.

It is another objective of this invention to provide a shoe having a sole fully contoured like and conforming to the natural form of the non-load-bearing human foot and deforming under load by flattening just as the foot does.

It is still another objective of this invention to provide a new stable shoe design wherein the heel lift or wedge increases in the sagittal plane the thickness of the shoe sole or toe taper decrease therewith so that the sides of the shoe sole which naturally conform to the sides of the foot also increase or decrease by exactly the same amount, so that the thickness of the shoe sole in a frontal planar cross section is always constant.

These and other objectives of the invention will become apparent from a detailed description of the invention which follows taken in conjunction with the accompanying drawings.

BRIEF DESCRIPTION OF THE DRAWINGS

In the drawings:

FIG. 1 is a perspective view of a typical running shoe known to the prior art to which the invention is applicable;

FIG. 2 shows, in FIGS. 2A and 2B, the obstructed natural motion of the shoe heel in frontal planar cross section rotating inwardly or outwardly with the shoe sole having a flared bottom in a conventional prior art design such as in FIG. 1; and—in FIGS. 2C and 2D, the efficient motion of a narrow rectangular shoe sole design;

FIG. 5 is diagrammatic sketch in FIGS. 5A and 5B, showing the novel contoured side sole design according to the invention with variable heel lift;

FIG. 6 is a side view of the novel stable contoured shoe according to the invention showing the contoured side design;

FIG. 7 shows, in FIGS. 7A–7D, a top view of the shoe sole shown in FIG. 6, wherein FIG. 7A is a cross-sectional view of the forefoot portion taken along lines 7A of FIG. 6 or 7; FIG. 7B is a view taken along lines 7B of FIGS. 6 and 7; and FIG. 7C is a cross-sectional view taken along the heel along lines 7C in FIGS. 6 and 7;

FIG. 8 is a drawn comparison between a conventional flared sole shoe of the prior art and the contoured shoe design according to the invention;

FIG. 9 shows, in FIGS. 9A–9C, the extremely stable conditions for the novel shoe sole according to the invention in its neutral and extreme situations;

FIG. 10 shows, in FIGS. 10A and 10B, a side cross-sectional view of the naturally contoured sole side showing how the sole maintains a constant distance from the ground during rotation of the shoe edge;

FIG. 12 shows, in FIGS. 12A–12D, frontal plane cross-sectional views of the shoe sole according to the invention showing a theoretically ideal stability plane and truncations of the sole side contour to reduce shoe bulk;

FIG. 13 shows, in FIGS. 13A–13C, the contoured sole design according to the invention when applied to various tread and cleat patterns;

FIG. 18 shows, in FIGS. 18A and 18B, a rear diagrammatic view of a human heel, as relating to a conventional shoe sole (FIG. 18A) and to the sole of the invention (FIG. 18B);

FIG. 19 shows, in FIGS. 19A–19F, the naturally contoured sides design extended to the other natural contours underneath the loadbearing foot such as the main longitudinal arch;

FIG. 20 illustrates, in FIGS. 20A–20E the fully contoured shoe sole design extended to the bottom of the entire non-load-bearing foot;

FIG. 21 shows the fully contoured shoe sole design abbreviated along the sides to only essential structural support and propulsion elements;

FIG. 22 illustrates, in FIGS. 22A and 22B, the application of the invention to provide a street shoe with a correctly contoured sole according to the invention and side edges perpendicular to the ground, as is typical of a street shoe;

FIG. 23 shows a method of establishing the theoretically ideal stability plane using a perpendicular to a tangent method;

FIG. 24 shows a circle radius method of establishing the theoretically ideal stability plane.

FIG. 25 illustrates, in FIGS. 25A and 25B, an alternate embodiment of the invention wherein the sole structure deforms in use to follow a theoretically ideal stability plane according to the invention during deformation;

FIG. 26 shows an embodiment wherein the contour of the sole according to the invention is approximated by a plurality of line segments;

FIG. 27 illustrates an embodiment wherein the stability sides are determined geometrically as a section of a ring;

DETAILED DESCRIPTION OF THE PREFERRED EMBODIMENT

Figure 3:
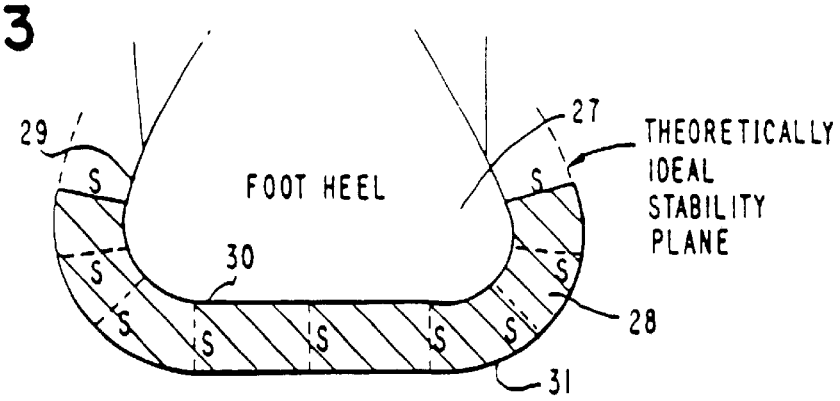
FIG. 3 is a frontal plane cross section showing a shoe sole of uniform thickness that conforms to the natural shape of the human foot, the novel shoe design according to the invention.

A perspective view of an athletic shoe, such as a typical running shoe, according to the prior art, is shown in FIG. 1 wherein a running shoe 20 includes an upper portion 21 and a sole 22. Typically, such a sole includes a truncated outwardly flared construction of the type best seen in FIG. 2 wherein the lower portion 22*a* of the sole heel is significantly wider than the upper portion 22*b* where the sole 22 joins the upper 21. A number of alternative sole designs are known to the art, including the design shown in U.S. Pat. No. 4,449,306 to Cavanagh wherein an outer portion of the sole of the running shoe includes a rounded portion having a radius of curvature of about 20 mm. The rounded portion lies along approximately the rear-half of the length of the outer side of the mid-sole and heel edge areas wherein the remaining border area is provided with a conventional flaring with the exception of a transition zone. The Misevich, U.S. Pat. No. 4,557,059 also shows an athletic shoe having a contoured sole bottom in the region of the first foot strike, in a shoe which otherwise uses an inverted flared sole.

In such prior art designs, and especially in athletic and in running shoes, the typical design attempts to achieve stability by flaring the heel as shown in FIGS. 2A and 2B to a width of, for example, 3 to 3½ inches on the bottom outer sole 22*a* of the average male shoe size (10D). On the other hand, the width of the corresponding human heel foot print, housed in the upper 21, is only about 2.25 in. for the average foot. Therefore, a mismatch occurs in that the heel is locked by the design into a firm shoe heel counter which supports the human heel by holding it tightly and which may also be re-enforced by motion control devices to stabilize the heel. Thus, for natural motion as is shown in FIGS. 2A and 2B, the human heel would normally move in a normal range of motion of approximately 15°, but as shown in FIGS. 2A and 2B the human heel cannot pivot except within the shoe and is resisted by the shoe. Thus, FIG. 2A illustrates the impossibility of pivoting about the center edge of the human heel as would be conventional for barefoot support about a point 23 defined by a line 23*a* perpendicular to the heel and intersecting the bottom edge of upper 21 at a point 24. The lever arm force moment of the flared sole is at a maximum at 0° and only slightly less at a normal 7° inversion or eversion and thus strongly resists such a natural motion as is illustrated in FIGS. 2A and 2B. In FIG. 2A, the outer edge of the heel must compress to accommodate such motion. FIG. 2B illustrates that normal natural motion of the shoe is inefficient in that the center of gravity of the shoe, and the shod foot, is forced upperwardly, as discussed later in connection with FIG. 17.

A narrow rectangular shoe sole design of heel width approximating human heel width is also known and is shown in FIGS. 2C and 2D. It appears to be more efficient than the conventional flared sole shown in FIGS. 2A and 2B. Since the shoe sole width is the same as human sole width, the shoe can pivot naturally with the normal 7° inversion/eversion motion of the running barefoot. In such a design, the lever arm length and the vertical motion of the center of gravity are approximately half that of the flared sole at a normal 7° inversion/eversion running motion. However, the narrow, human heel width rectangular shoe design is extremely unstable and therefore prone to ankle sprain, so that it has not been well received. Thus, neither of these wide or narrow designs is satisfactory.

FIG. 3 shows in a frontal plane cross section at the heel (center of ankle joint) the general concept of the applicant's design: a shoe sole 28 that conforms to the natural shape of the human foot 27 and that has a constant thickness (s) in frontal plane cross sections. The surface 29 of the bottom and sides of the foot 27 should correspond exactly to the upper surface 30 of the shoe sole 28. The shoe sole thickness is defined as the shortest distance (s) between any point on the upper surface 30 of the shoe sole 28 and the lower surface 31 (FIGS. 23 and 24 will discuss measurement methods more fully). In effect, the applicant's general concept is a shoe sole 28 that wraps around and conforms to the natural contours of the foot 27 as if the shoe sole 28 were made of a theoretical single flat sheet of shoe sole material of uniform thickness, wrapped around the foot with no distortion or deformation of that sheet as it is bent to the foot's contours. To overcome real world deformation problems associated with such bending- or wrapping around contours, actual construction of the shoe sole contours of uniform thickness will preferably involve the use of multiple sheet lamination or injection molding techniques.

Figure 4:
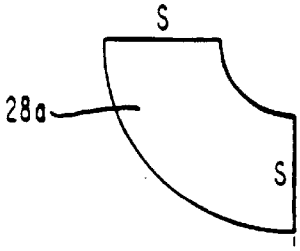
FIG. 4 shows, in FIGS. 4A–4D, a load-bearing flat component of a shoe sole and naturally contoured stability side component, as well as a preferred horizontal periphery of the flat load-bearing portion of the shoe sole when using the sole of the invention.
Figure 4A:
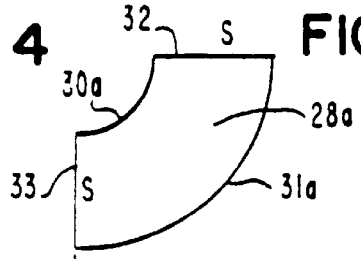
Figure 4B:
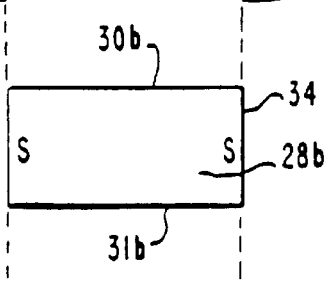
Figure 4C:
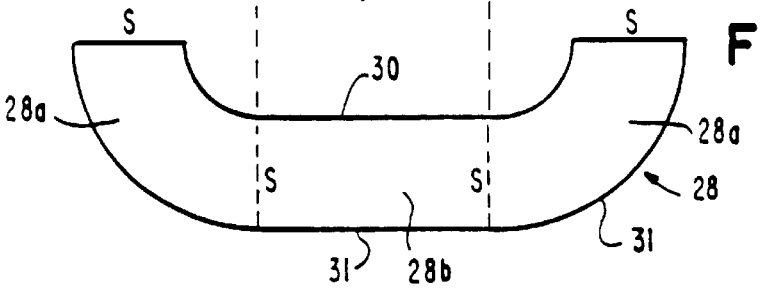
Figure 4D:
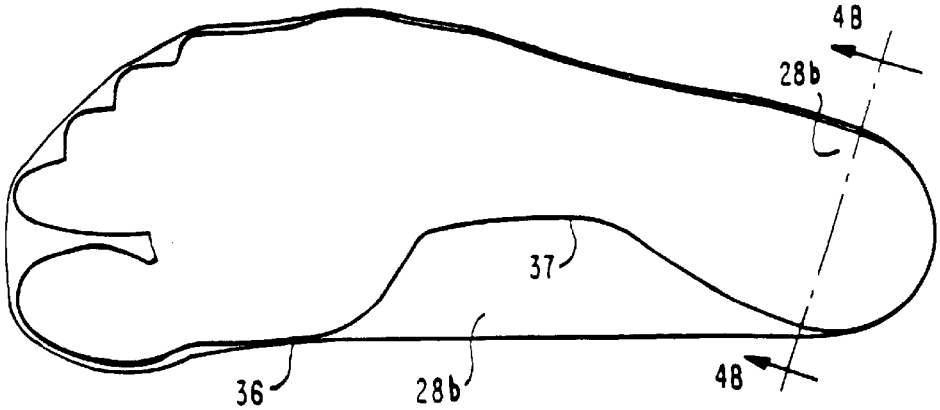

FIGS. 4A, 4B, and 4C illustrate in frontal plane cross section a significant element of the applicant's shoe design in its use of naturally contoured stabilizing sides 28*a* at the outer edge of a shoe sole 28*b* illustrated generally at the reference numeral 28. It is thus a main feature of the applicant's invention to eliminate the unnatural sharp bottom edge, especially of flared shoes, in favor of a naturally contoured shoe sole outside 31 as shown in FIG. 3. The side or inner edge 30*a* of the shoe sole stability side 28*a* is contoured like the natural form on the side or edge of the human foot, as is the outside or outer edge 31*a* of the shoe sole stability side 28*a* to follow a theoretically ideal stability plane. According to the invention, the thickness (s) of the shoe sole 28 is maintained exactly constant, even if the shoe sole is tilted to either side, or forward or backward. Thus, the naturally contoured stabilizing sides 28*a,* according to the applicant's invention, are defined as the same as the thickness 33 of the shoe sole 28 so that, in cross section, the shoe sole comprises a stable shoe sole 28 having at its outer edge naturally contoured stabilizing sides 28*a* with a surface 31*a* representing a portion of a theoretically ideal stability plane and described by naturally contoured sides equal to the thickness (s) of the sole 28. The top of the shoe sole 30*b* coincides with the shoe wearer's load-bearing footprint, since in the case shown the shape of the foot is assumed to be load-bearing and therefore flat along the bottom. A top edge 32 of the naturally contoured stability side 28*a* can be located at any point along the contoured side of the foot 29, while the inner edge 33 of the naturally contoured side 28*a* coincides with the perpendicular sides 34 of the load-bearing shoe sole 28*b*. In practice, the shoe sole 28 is preferably integrally formed from the portions 28*b* and 28*a*. Thus, the theoretically ideal stability plane includes the contours 31*a* merging into the lower surface 31*b* of the sole 28. Preferably, the peripheral extent 36 of the load-bearing portion of the sole 28*b* of the shoe includes all of the support structures of the foot but extends no further than the outer edge of the foot sole 37 as defined by a loadbearing footprint, as shown in FIG. 4D, which is a top view of the upper shoe sole surface 30*b*. FIG. 4D thus illustrates a foot outline at numeral 37 and a recommended sole outline 36 relative thereto. Thus, a horizontal plane outline of the top of the load-bearing portion of the shoe sole, therefore exclusive of contoured stability sides, should, preferably, coincide as nearly as practicable with the load-bearing portion of the foot sole with which it comes into contact. Such a horizontal outline, as best seen in FIGS. 4D and 7D, should remain uniform throughout the entire thickness of the shoe sole eliminating negative or positive sole flare so that the sides are exactly perpendicular to the horizontal plane as shown in FIG. 4B. Preferably, the density of the shoe sole material is uniform.

Another significant feature of the applicant's invention is illustrated diagrammatically in FIG. 5. Preferably, as the heel lift or wedge 38 of thickness (s1) increases the total thickness (s+s1) of the combined midsole and outersole 39 of thickness (s) in an aft direction of the shoe, the naturally contoured sides 28*a* increase in thickness exactly the same amount according to the principles discussed in connection with FIG. 4. Thus, according to the applicant's design, the thickness of the inner edge 33 of the naturally contoured side is always equal to the constant thickness (s) of the load-bearing shoe sole 28*b* in the frontal cross-sectional plane.

As shown in FIG. 5B, for a shoe that follows a more conventional horizontal plane outline, the sole can be improved significantly according to the applicant's invention by the addition of a naturally contoured side 28*a* which correspondingly varies with the thickness of the shoe sole and changes in the frontal plane according to the shoe heel lift. Thus, as illustrated in FIG. 5B, the thickness of the naturally contoured side 28*a* is equal to the thickness (s+s1) of the shoe sole 28 which is thicker than the shoe sole (s)

shown in FIG. 5A by an amount equivalent to the heel lift (s1). In the generalized case, the thickness (s) of the contoured side is thus always equal to the thickness (s) of the shoe sole.

FIG. 6 illustrates a side cross-sectional view of a shoe to which the invention has been applied and is also shown in a top plane view in FIG. 7. Thus, FIGS. 7A, 7B and 7C represent frontal plane cross-sections taken along the forefoot, at the base of the fifth metatarsal, and at the heel, thus illustrating that the shoe sole thickness is constant at each frontal plane cross-section, even though that thickness varies from front to back, due to the heel lift 38 as shown in FIG. 6, and that the thickness of the naturally contoured sides is equal to the shoe sole thickness in each FIGS. 7A–7C cross section. Moreover, in FIG. 7D, a horizontal plane overview of the left foot, it can be seen that the contour of the sole follows the preferred principle in matching, as nearly as practical, the load-bearing sole print shown in FIG. 4D.

FIG. 8 thus contrasts in frontal plane cross section the conventional flared sole 22 shown in phantom outline and illustrated in FIG. 2 with the contoured shoe sole 28 according to the invention as shown in FIGS. 3–7.

FIG. 9 is suitable for analyzing the shoe sole design according to the applicant's invention by contrasting the neutral situation shown in FIG. 9A with the extreme situations shown in FIGS. 9B and 9C. Unlike the sharp sole edge of a conventional shoe as shown in FIG. 2, the effect of the applicants invention having a naturally contoured side 28*a* is totally neutral allowing the shod foot to react naturally with the ground 43, in either an inversion or eversion mode. This occurs in part because of the unvarying thickness along the shoe sole edge which keeps the foot sole equidistant from the ground in a preferred case. Moreover, because the shape of the edge 31*a* of the shoe contoured side 28*a* is exactly like that of the edge of the foot, the shoe is enabled to react naturally with the ground in a manner as closely as possible simulating the foot. Thus, in the neutral position shown in FIG. 9, any point 40 on the surface of the shoe sole 30*b* closest to ground lies at a distance (s) from the ground surface 39. That distance (s) remains constant even for extreme situations as seen in FIGS. 9B and 9C.

A main point of the applicant's invention, as is illustrated in FIGS. 9B and 9C, is that the design shown is stable in an in extremis situation. The ideal plane of stability where the stability plane is defined as sole thickness which is constant under all load-bearing points of the foot sole for any amount from 0° to 90° rotation of the sole to either side or front and back. In other words, as shown in FIG. 9, if the shoe is tilted from 0° to 90° to either side or from 0° to 90° forward or backward representing a 0° to 90° foot dorsiflexion or 0° to 90° plantarflexion, the foot will remain stable because the sole thickness (s) between the foot and the ground always remain constant because of the exactly contoured quadrant sides. By remaining a constant distance from the ground, the stable shoe allows the foot to react to the ground as if the foot were bare while allowing the foot to be protected and cushioned by the shoe. In its preferred embodiment, the new naturally contoured sides will effectively position and hold the foot onto the load-bearing foot print section of the shoe sole, reducing the need for heel counters and other motion control devices.

FIG. 10A illustrates how the inner edge 30*a* of the naturally contoured sole side 28*a* is maintained at a constant distance (s) from the ground through various degrees of rotation of the edge 31*a* of the shoe sole such as is shown in FIG. 9.

FIG. 10B shows how a conventional shoe sole pivots around its lower edge 42, which is its center of rotation, instead of around the upper edge 40, which, as a result, is not maintained at constant distance (s) from the ground, as with the invention, but is lowered to 0.7(s) at 45° rotation and to zero at 90° rotation.

Figures 11, 11A, 11B, 11C, 11D, 11E:
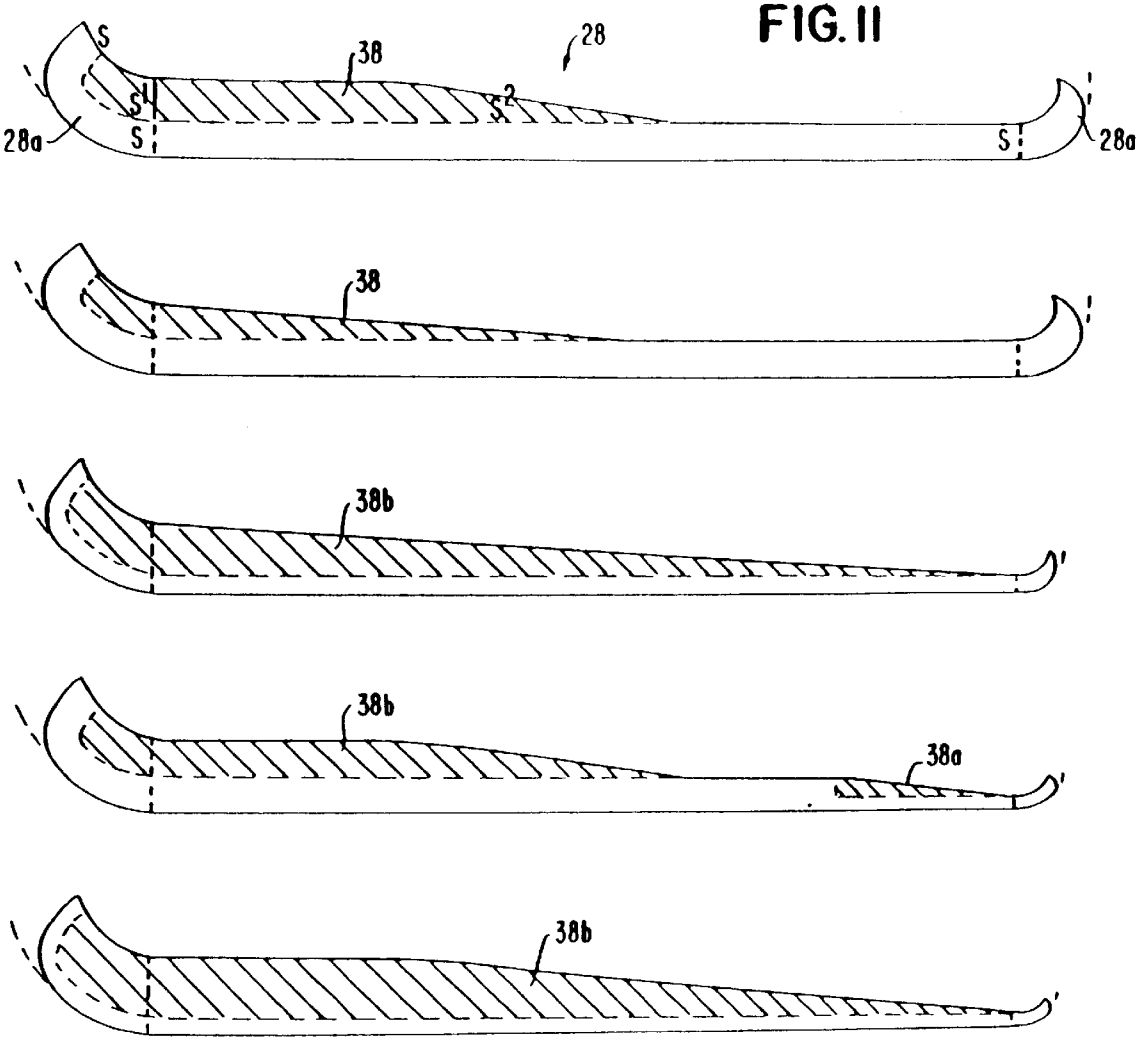
FIG. 11 shows, in FIGS. 11A–11E, a plurality of side sagittal plane cross-sectional views showing examples of conventional sole thickness variations to which the invention can be applied.

FIG. 11 shows typical conventional sagittal plane shoe sole thickness variations, such as heel lifts or wedges 38, or toe taper 38*a,* or full sole taper 38*b,* in FIGS. 11A–11E and how the naturally contoured sides 28*a* equal and therefore vary with those varying thicknesses as discussed in connection with FIG. 5.

FIG. 12 illustrates an embodiment of the invention which utilizes varying portions of the theoretically ideal stability plane 51 in the naturally contoured sides 28*a* in order to reduce the weight and bulk of the sole, while accepting a sacrifice in some stability of the shoe. Thus, FIG. 12A illustrates the preferred embodiment as described above in connection with FIG. 5 wherein the outer edge 31*a* of the naturally contoured sides 28*a* follows a theoretically ideal stability plane 51. As in FIGS. 3 and 4, the contoured surfaces 31*a,* and the lower surface of the sole 31*b* lie along the theoretically ideal stability plane 51. The theoretically ideal stability plane 51 is defined as the plane of the surface of the bottom of the shoe sole 31, wherein the shoe sole conforms to the natural shape of the foot, particularly the sides, and has a constant thickness in frontal plane cross sections. As shown in FIG. 12B, an engineering trade off results in an abbreviation within the theoretically ideal stability plane 51 by forming a naturally contoured side surface 53*a* approximating the natural contour of the foot (or more geometrically regular, which is less preferred) at an angle relative to the upper plane of the shoe sole 28 so that only a smaller portion of the contoured side 28*a* defined by the constant thickness lying along the surface 31*a* is coplanar with the theoretically ideal stability plane 51. FIGS. 12C and 12D show similar embodiments wherein each engineering trade-off shown results in progressively smaller portions of contoured side 28*a,* which lies along the theoretically ideal stability plane 51. The portion of the surface 31*a* merges into the upper side surface 53*a* of the naturally contoured side.

The embodiment of FIG. 12 may be desirable for portions of the shoe sole which are less frequently used so that the additional part of the side is used less frequently. For example, a shoe may typically roll out laterally, in an inversion model to about 20° on the order of 100 times for each single time it rolls out to 40°. For a basketball shoe, shown in FIG. 12B, the extra stability is needed. Yet, the added shoe weight to cover that infrequently experienced range of motion is about equivalent to covering the frequently encountered range. Since, in a racing shoe this weight might not be desirable, an engineering trade-off of the type shown in FIG. 12D is possible. A typical running/jogging shoe is shown in FIG. 12C. The range of possible variations is limitless.

FIG. 13 shows the theoretically ideal stability plane 51 in defining embodiments of the shoe sole having differing tread or cleat patterns. Thus, FIG. 13 illustrates that the invention is applicable to shoe soles having conventional bottom treads. Accordingly, FIG. 13A is similar to FIG. 12B further including a tread portion 60, while FIG. 13B is also similar to FIG. 12B wherein the sole includes a cleated portion 61. The surface 63 to which the cleat bases are affixed should preferably be on the same plane and parallel the theoretically ideal stability plane 51, since in soft ground that surface rather than the cleats become loadbearing. The embodiment in FIG. 13C is similar to FIG. 12C showing still an alternative tread construction 62. In each case, the load-bearing outer surface of the tread or cleat pattern 60–62 lies along the theoretically ideal stability plane 51.

Figure 14:
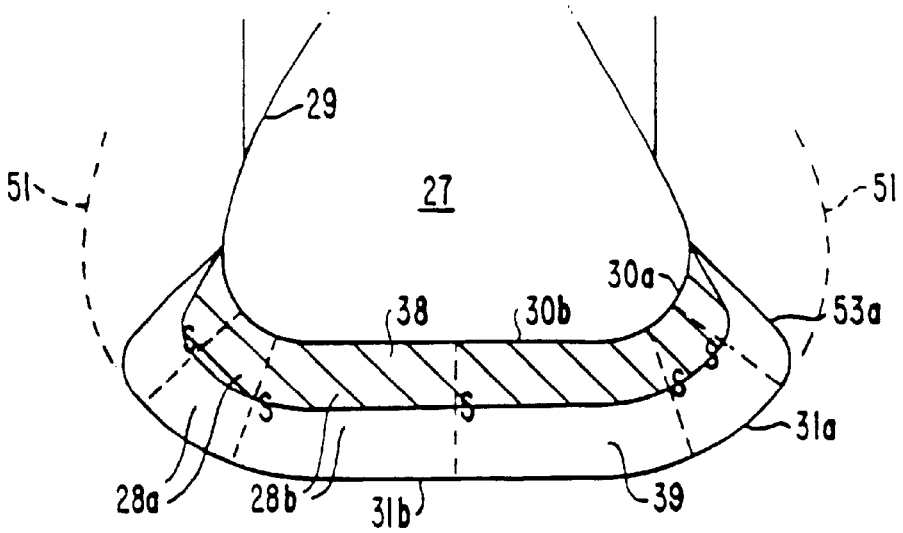
FIG. 14 illustrates, in a rear view, an application of the sole according to the invention to a shoe to provide an aesthetically pleasing and functionally effective design.

FIG. 14 shows, in a rear cross sectional view, the application of the invention to a shoe to produce an aesthetically pleasing and functionally effective design. Thus, a practical design of a shoe incorporating the invention is feasible, even when applied to shoes incorporating heel lifts 38 and a combined midsole and outersole 93. Thus, use of a sole surface and sole outer contour which track the theoretically ideal stability plane does not detract from the commercial appeal of shoes incorporating the invention.

Figure 15:
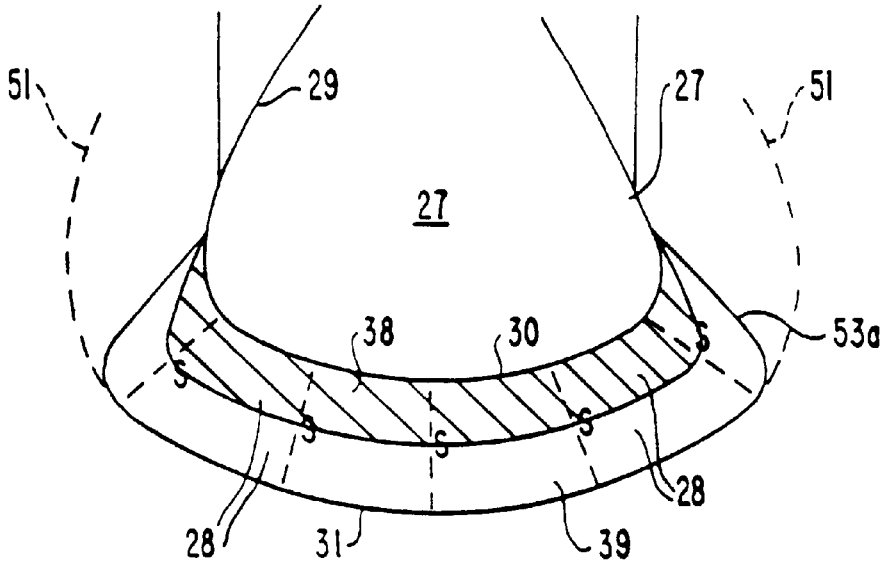
FIG. 15 shows a fully contoured shoe sole design that follows the natural contour of the bottom of the foot as well as the sides.

FIG. 15 shows a fully contoured shoe sole design that follows the natural contour of all of the foot, the bottom as well as the sides. The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 15 would deform by flattening to look essentially like FIG. 14. Seen in this light, the naturally contoured side design in FIG. 14 is a more conventional, conservative design that is a special case of the more general fully contoured design in FIG. 15, which is the closest to the natural form of the foot, but the least conventional. The amount of deformation flattening used in the FIG. 14 design, which obviously varies under different loads, is not an essential element of the applicant's invention.

FIGS. 14 and 15 both show in frontal plane cross section the essential concept underlying this invention, the theoretically ideal stability plane, which is also theoretically ideal for efficient natural motion of all kinds, including running, jogging or walking. FIG. 15 shows the most general case of the invention, the fully contoured design, which conforms to the natural shape of the unloaded foot. For any given individual, the theoretically ideal stability plane 31 is determined, first, by the desired shoe sole thickness (s) in a frontal plane cross section, and, second, by the natural shape of the individuals foot surface 29.

For the special case shown in FIG. 14, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individuals load-bearing footprint 30*b*, which is defined as the upper surface of the shoe sole that is in physical contact with and supports the human foot sole, as shown in FIG. 4.

The theoretically ideal stability plane for the special case is composed conceptionally of two parts. Shown in FIGS. 14 and 4 the first part is a line segment 31*b* of equal length and parallel to 30*b* at a constant distance (s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness (s) from the closest point on the contoured side inner edge 30*a*.

In summary, the theoretically ideal stability plane is the essence of this invention because it is used to determine a geometrically precise bottom contour of the shoe sole based on a top contour that conforms to the contour of the foot. This invention specifically claims the exactly determined geometric relationship just described. It can be stated unequivocally that any shoe sole contour, even of similar contour, that exceeds the theoretically ideal stability plane will restrict natural foot motion, while any less than that plane will degrade natural stability, in direct proportion to the amount of the deviation.

Figure 16:
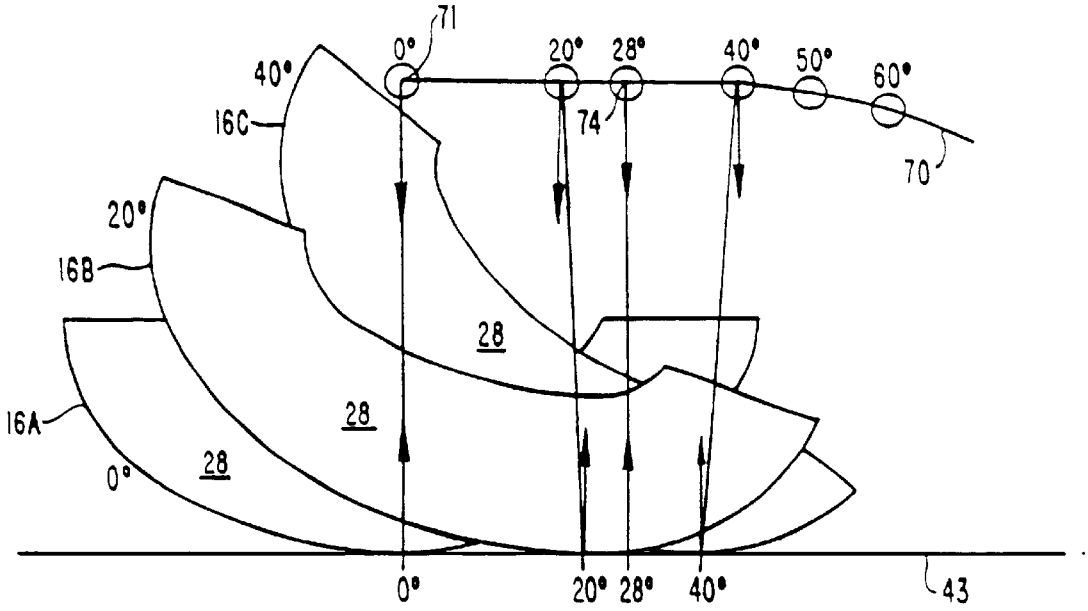
FIG. 16 is a diagrammatic side cross-sectional view of static forces acting on the ankle joint and its position relative to the shoe sole according to the invention during normal and extreme inversion and eversion motion.

FIG. 16 illustrates in a curve 70 the range of side to side inversion/eversion motion of the ankle center of gravity 71 from the shoe according to the invention shown in frontal plane cross section at the ankle. Thus, in a static case where the center of gravity 71 lies at approximately the mid-point of the sole, and assuming that the shoe inverts or everts from 0° to 20° to 40°, as shown in progressions 16*a*, 16*b* and 16*c*, the locus of points of motion for the center of gravity thus defines the curve 70 wherein the center of gravity 71 maintains a steady level motion with no vertical component through 40° of inversion or eversion. For the embodiment shown, the shoe sole stability equilibrium point is at 28° (at point 74) and in no case is there a pivoting edge to define a rotation point as in the case of FIG. 2. The inherently superior side to side stability of the design provides pronation control (or eversion), as well as lateral (or inversion) control. In marked contrast to conventional shoe sole designs, the applicant's shoe design creates virtually no abnormal torque to resist natural inversion/eversion motion or to destabilize the ankle joint.

Figure 17:
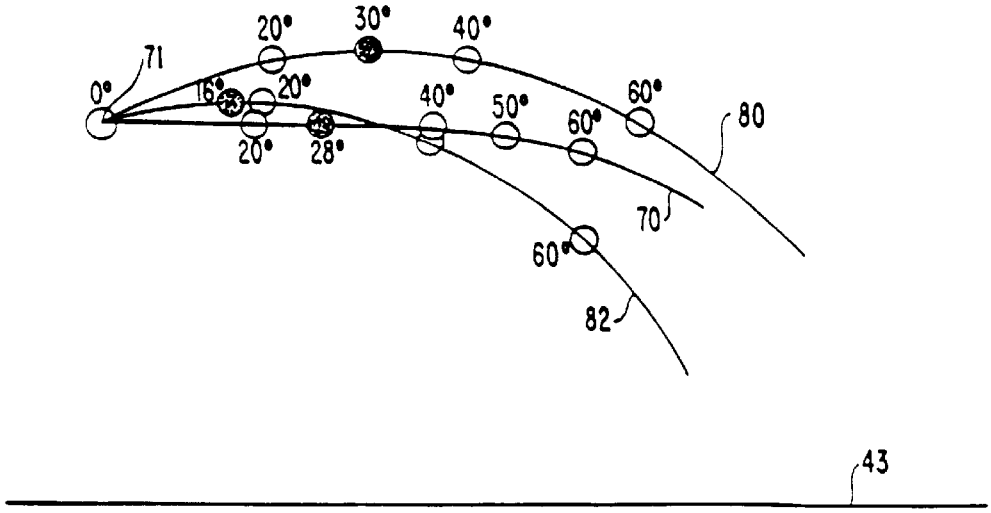
FIG. 17 is a diagrammatic view of a plurality of moment curves of the center of gravity for various degrees of inversion for the shoe sole according to the invention, and contrasted to the motions shown in FIG. 2.

FIG. 17 thus compares the range of motion of the center of gravity for invention, as shown in curve 75, in comparison to curve 80 for the conventional wide heel flare and a curve 82 for a narrow rectangle the width of a human heel. Since the shoe stability limit is 28° in the inverted mode, the shoe sole is stable at the 20° approximate barefoot inversion limit. That factor, and the broad base of support rather than the sharp bottom edge of the prior art, make the contour design stable even in the most extreme case as shown in FIG. 16 and permit the inherent stability of the barefoot to dominate without interference, unlike existing designs, by providing constant, unvarying shoe sole thickness in frontal plane cross sections. The stability superiority of the contour side design is thus clear when observing how much flatter its center of gravity curve 75 is than in existing popular wide flare design 80. The curve demonstrates that the contour side design has significantly more efficient natural 7° inversion/eversion motion than the narrow rectangle design the width of a human heel, and very much more efficient than the conventional wide flare design; at the same time, the contour side design is more stable in extremis than either conventional design because of the absence of destabilizing torque.

FIG. 18A illustrates, in a pictorial fashion, a comparison of a cross section at the ankle joint of a conventional shoe with a cross section of a shoe according to the invention when engaging a heel. As seen in FIG. 18A, when the heel of the foot 27 of the wearer engages an upper surface of the shoe sole 22, the shape of the foot heel and the shoe sole is such that the shoe sole 22 conforms to the contour of the ground 43 and not to the contour of the sides of the foot 27. As a result, the shoe sole 22 cannot follow the natural 7° inversion/eversion motion of the foot, and that normal motion is resisted by the shoe upper 21, especially when strongly reinforced by firm heel counters and motion control devices. This interference with natural motion represents the fundamental misconception of the currently available designs. That misconception on which existing shoe designs are based is that, while shoe uppers are considered as a part of the foot and conform to the shape of the foot, the shoe sole is functionally conceived of as a part of the ground and is therefore shaped like the ground, rather than the foot.

In contrast, the new design, as illustrated in FIG. 18B, illustrates a correct conception of the shoe sole 28 as a part of the foot and an extension of the foot, with shoe sole sides contoured exactly like those of the foot, and with the frontal plane thickness of the shoe sole between the foot and the ground always the same and therefore completely neutral to the natural motion of the foot. With the correct basic conception, as described in connection with this invention, the shoe can move naturally with the foot, instead of restraining it, so both natural stability and natural efficient motion coexist in the same shoe, with no inherent contradiction in design goals.

Thus, the contoured shoe design of the invention brings together in one shoe design the cushioning and protection typical of modern shoes, with the freedom from injury and functional efficiency, meaning speed, and/or endurance, typical of barefoot stability and natural freedom of motion. Significant speed and endurance improvements are anticipated, based on both improved efficiency and on the ability of a user to train harder without injury.

These figures also illustrate that the shoe heel cannot pivot ±7 degrees with the prior art shoe of FIG. 18A. In contrast the shoe heel in the embodiment of FIG. 18B pivots with the natural motion of the foot heel.

FIGS. 19A–D illustrate, in frontal plane cross sections, the naturally contoured sides design extended to the other natural contours underneath the load-bearing foot, such as the main longitudinal arch, the metatarsal (or forefoot) arch, and the ridge between the heads of the metatarsals (forefoot) and the heads of the distal phalanges (toes). As shown, the shoe sole thickness remains constant as the contour of the shoe sole follows that of the sides and bottom of the load-bearing foot. FIG. 19E shows a sagittal plane cross section of the shoe sole conforming to the contour of the bottom of the load-bearing foot, with thickness varying according to the heel lift 38. FIG. 19F shows a horizontal plane top view of the left foot that shows the areas 85 of the shoe sole that corresponds to the flattened portions of the foot sole that are in contact with the ground when loadbearing. Contour lines 86 and 87 show approximately the relative height of the shoe sole contours above the flattened load-bearing areas 85 but within roughly the peripheral extent 36 of the load-bearing portion of sole 28*b* shown in FIG. 4. A horizontal plane bottom view (not shown) of FIG. 19F would be the exact reciprocal or converse of FIG. 19F (i.e., peaks and valleys contours would be exactly reversed).

FIGS. 20A–D show, in frontal plane cross sections, the fully contoured shoe sole design extended to the bottom of the entire non-load-bearing foot. FIG. 20E shows a sagittal plane cross section. The shoe sole contours underneath the foot are the same as FIGS. 19A–E except that there are no flattened areas corresponding to the flattened areas of the load-bearing foot. The exclusively rounded contours of the shoe sole follow those of the unloaded foot. A heel lift 38, the same as that of FIG. 19, is incorporated in this embodiment, but is not shown in FIG. 20.

FIG. 21 shows the horizontal plane top view of the left foot corresponding to the fully contoured design described in FIGS. 20A–E, but abbreviated along the sides to only essential structural support and propulsion elements. Shoe sole material density can be increased in the unabbreviated essential elements to compensate for increased pressure loading there. The essential structural support elements are the base and lateral tuberosity of the calcaneus 95, the heads of the metatarsals 96, and the base of the fifth metatarsal 97. They must be supported both underneath and to the outside for stability. The essential propulsion element is the head of first distal phalange 98. The medial (inside) and lateral (outside) sides supporting the base of the calcaneus are shown in FIG. 21 oriented roughly along either side of the horizontal plane subtalar ankle joint axis, but can be located also more conventionally along the longitudinal axis of the shoe sole. FIG. 21 shows that the naturally contoured stability sides need not be used except in the identified essential areas. Weight savings and flexibility improvements can be made by omitting the non-essential stability sides. Contour lines 85 through 89 show approximately the relative height of the shoe sole contours within roughly the peripheral extent 36 of the undeformed load-bearing portion of shoe sole 28*b* shown in FIG. 4. A horizontal plane bottom view (not shown) of FIG. 21 would be the exact reciprocal or converse of FIG. 21 (i.e., peaks and valleys contours would be exactly reversed).

FIG. 22A shows a development of street shoes with naturally contoured sole sides incorporating the features of the invention. FIG. 22A develops a theoretically ideal stability plane 51, as described above, for such a street shoe, wherein the thickness of the naturally contoured sides equal the shoe sole thickness. The resulting street shoe with a correctly contoured sole is thus shown in frontal plane heel cross section in FIG. 22A, with side edges perpendicular to the ground, as is typical. FIG. 22B shows a similar street shoe with a fully contoured design, including the bottom of the sole. Accordingly, the invention can be applied to an unconventional heel lift shoe, like a simple wedge, or to the most conventional design of a typical walking shoe with its heel separated from the forefoot by a hollow under the instep. The invention can be applied just at the shoe heel or to the entire shoe sole. With the invention, as so applied, the stability and natural motion of any existing shoe design, except high heels or spike heels, can be significantly improved by the naturally contoured shoe sole design.

FIG. 23 illustrates a method of measuring shoe sole thickness in accordance with the present invention. The thickness (s) of the sole at a particular location is measured between the inner surface 30 and the outer surface 31 by the length of a line extending perpendicular to a line tangent to the sole inner surface at the measured location, all as viewed in a frontal plane cross section of the sole. This thickness (s) may also be referred to as a "radial thickness" of the shoe sole.

FIG. 24 illustrates another approach to constructing the theoretically ideal stability plane, and one that is easier to use, the circle radius method. By that method, the pivot point (circle center) of a compass is placed at the beginning of the foot sole's natural side contour (frontal plane cross section) and roughly a 90° arc (or much less, if estimated accurately) of a circle of radius equal to (s) or shoe sole thickness is drawn describing the area farthest away from the foot sole contour. That process is repeated all along the foot sole's natural side contour at very small intervals (the smaller, the more accurate). When all the circle sections are drawn, the outer edge farthest from the foot sole contour (again, frontal plane cross section) is established at a distance of "s" and that outer edge coincides with the theoretically ideal stability plant. Both this method and that described in FIG. 23 would be used for both manual and CADCAM design applications.

The shoe sole according to the invention can be made by approximating the contours, as indicated in FIGS. 25A, 25B, and 26. FIG. 25A shows a frontal plane cross section of a design wherein the sole material in areas 107 is so relatively soft that it deforms easily to the contour of shoe sole 28 of the proposed invention. In the proposed approximation as seen in FIG. 25B, the heel cross section includes a sole upper surface 101 and a bottom sole edge surface 102 following when deformed an inset theoretically ideal stability plane 51. The sole edge surface 102 terminates in a laterally extending portion 103 joined to the heel of the sole 28. The laterally-extending portion 103 is made from a flexible material and structured to cause its lower surface 102 to terminate during deformation to parallel the inset theoretically ideal stability plane 51. Sole material in specific areas 107 is extremely soft to allow sufficient deformation. Thus, in a dynamic case, the outer edge contour assumes approximately the theoretically ideal stability shape described above as a result of the deformation of the portion 103. The top surface 101 similarly deforms to approximately parallel the natural contour of the foot as described by lines 30*a* and 30*b* shown in FIG. 4.

It is presently contemplated that the controlled or programmed deformation can be provided by either of two techniques. In one, the shoe sole sides, at especially the midsole, can be cut in a tapered fashion or grooved so that the bottom sole bends inwardly under pressure to the correct contour. The second uses an easily deformable material 107 in a tapered manner on the sides to deform under pressure to the correct contour. While such techniques produce stability and natural motion results which are a significant improvement over conventional designs, they are inherently inferior to contours produced by simple geometric shaping. First, the actual deformation must be produced by pressure which is unnatural and does not occur with a bare foot and second, only approximations are possible by deformation, even with sophisticated design and manufacturing techniques, given an individuals particular running gait or body weight. Thus, the deformation process is limited to a minor effort to correct the contours from surfaces approximating the ideal curve in the first instance.

The theoretically ideal stability can also be approximated by a plurality of line segments 110, such as tangents, chords, or other lines. as shown in FIG. 26. Both the upper surface of the shoe sole 28, which coincides with the side of the foot 30*a*, and the bottom surface 31*a* of the naturally contoured side can be approximated. While a single flat plane 110 approximation may correct many of the biomechanical problems occurring with existing designs, because it can provide a gross approximation of the both natural contour of the foot and the theoretically ideal stability plane 51, the single plane approximation is presently not preferred, since it is the least optimal. By increasing the number of flat planar surfaces formed, the curve more closely approximates the ideal exact design contours, as previously described. Single and double plane approximations are shown as line segments in the cross section illustrated in FIG. 26.

FIG. 27 shows a frontal plane cross section of an alternate embodiment for the invention showing stability sides component 28*a* that are determined in a mathematically precise manner to conform approximately to the sides of the foot. (The center or load-bearing shoe sole component 28*b* would be as described in FIG. 4). The component sides 28*a* would be a quadrant of a circle of radius ($r+r^1$), where distance (r) must equal sole thickness (s); consequently the sub-quadrant of radius ($r^1$) is removed from quadrant ($r+r^1$). In geometric terms, the component side 28*a* is thus a quarter or other section of a ring. The center of rotation 115 of the quadrants is selected to achieve a sole upper side surface 30*a* that closely approximates the natural contour of the side of the human foot.

FIG. 27 provides a direct bridge to another invention by the applicant, a shoe sole design with quadrant stability sides.

FIG. 28 shows a shoe sole design that allows for unobstructed natural inversion/eversion motion of the calcaneus by providing maximum shoe sole flexibility particularly between the base of the calcaneus 125 (heel) and the metatarsal heads 126 (forefoot) along an axis 120. An unnatural torsion occurs about that axis if flexibility is insufficient so that a conventional shoe sole interferes with the inversion/eversion motion by restraining it. The object of the design is to allow the relatively more mobile (in eversion and inversion) calcaneus to articulate freely and independently from the relatively more fixed forefoot, instead of the fixed or fused structure or lack of stable structure between the two in conventional designs. In a sense, freely articulating joints are created in the shoe sole that parallel those of the foot. The design is to remove nearly all of the shoe sole material between the heel and the forefoot, except under one of the previously described essential structural support elements, the base of the fifth metatarsal 97. An optional support for the main longitudinal arch 121 may also be retained for runners with substantial foot pronation, although would not be necessary for many runners. The forefoot can be subdivided (not shown) into its component essential structural support and propulsion elements, the individual heads of the metatarsal and the heads of the distal phalanges, so that each major articulating joint set of the foot is paralleled by a freely articulating shoe sole support propulsion element, an anthropomorphic design; various aggregations of the subdivisions are also possible. An added benefit of the design is to provide better flexibility along axis 122 for the forefoot during the toe-off propulsive phase of the running stride, even in the absence of any other embodiments of the applicant's invention; that is, the benefit exists for existing conventional shoe sole designs.

Figure 28C:
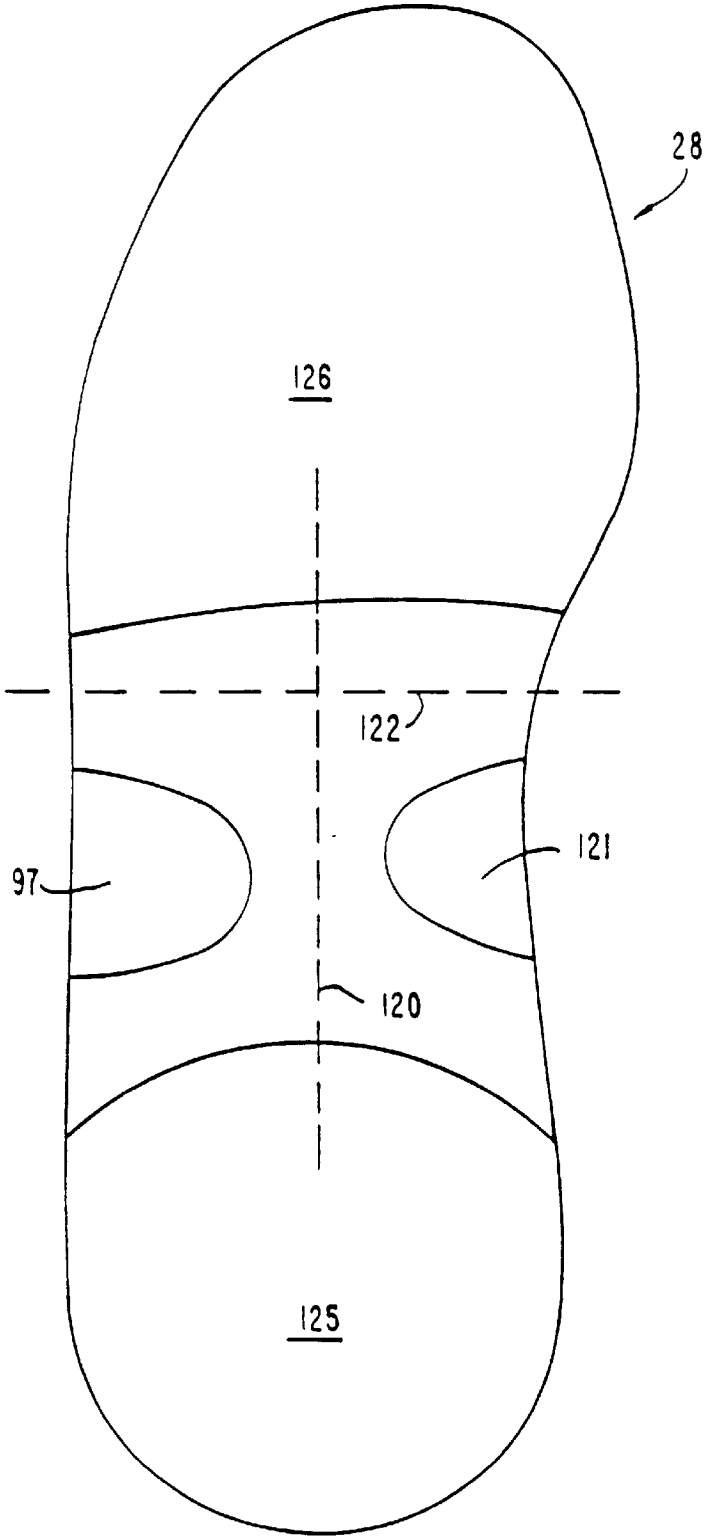
FIG. 28 shows, in FIGS. 28A–28C, a shoe sole design that allows for unobstructed natural eversion/inversion motion by providing torsional flexibility in the instep area of the shoe sole.

FIG. 28A shows in sagittal plane cross section a specific design maximizing flexibility, with large nonessential sections removed for flexibility and connected by only a top layer (horizontal plane) of non-stretching fabric 123 like Dacron polyester or Kevlar. FIG. 28B shows another specific design with a thin top sole layer 124 instead of fabric and a different structure for the flexibility sections: a design variation that provides greater structural support, but less flexibility though still much more than conventional designs. Not shown is a simple, minimalist approach, which is comprised of single frontal plane slits in the shoe sole material (all layers or part): the first midway between the base of the calcaneus and the base of the fifth metatarsal, and the second midway between that base and the metatarsal heads. FIG. 28C shows a bottom view (horizontal plane) of the inversion/eversion flexibility design.

Figure 29:
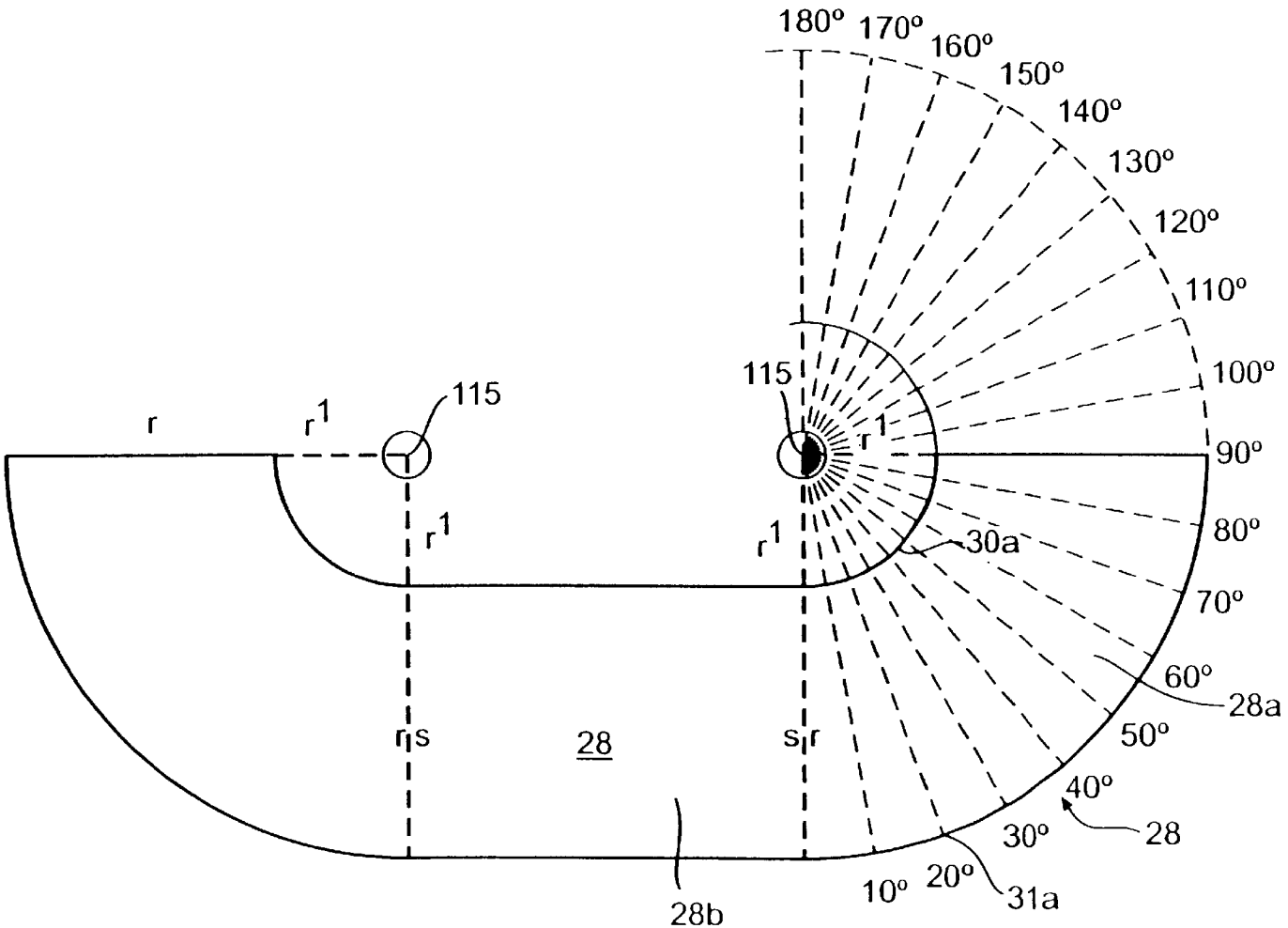
FIG. 29 illustrates a process for measuring the contoured shoe sole sides of the applicant's invention.

FIG. 29 is new in this continuation-in-part application and provides a means to measure the contoured shoe sole sides incorporated in the applicant's inventions described above. FIG. 29 is FIG. 27 modified to correlate the height or extent of the contoured side portions of the shoe sole with a precise angular measurement from zero to 180 degrees. That angular measurement corresponds roughly with the support for sideways tilting provided by the contoured shoe sole sides of any angular amount from zero degrees to 180 degrees, at least for such contoured sides proximate to any one or more or all of the essential stability or propulsion structures of the foot, as defined above in FIG. 21. The contoured shoe sole sides as described in this application can have any angular measurement from zero degrees to 180 degrees.

Thus, it will clearly be understood by those skilled in the art that the foregoing description has been made in terms of the preferred embodiment and various changes and modifications may be made without departing from the scope of the present invention which is to be defined by the appended claims.

What is claimed is:

1. A sole of a shoe, comprising:

a sole outer surface;

a sole inner surface for supporting a foot of an intended wearer when inside the shoe;

a heel portion at a location substantially corresponding to a location of a calcaneus bone of the foot of the intended wearer when inside the shoe;

a forefoot portion at a location substantially corresponding to a location of a forefoot of the foot of the intended wearer when inside the shoe; and a midtarsal portion located between the heel portion and the forefoot portion;

the sole heel, midtarsal and forefoot portions having a sole medial side, a sole lateral side, and a sole middle portion between the sole sides;

the heel portion having a lateral heel part at a location substantially corresponding to a location of a lateral tuberosity of the calcaneus bone of the foot of the intended wearer when inside the shoe, and a medial heel part at a location substantially corresponding to a location of a base of the calcaneus bone of the foot of the intended wearer when inside the shoe;

the midtarsal portion having a lateral midtarsal part at a location substantially corresponding to a location of a base of a fifth metatarsal bone of the foot of the intended wearer when inside the shoe;

the forefoot portion having a forward medial forefoot part at a location substantially corresponding to a location of a head of a first distal phalange bone of the foot of the intended wearer when inside the shoe, a rear medial forefoot part at a location substantially corresponding to a location of a head of a first metatarsal bone of the foot of the intended wearer when inside the shoe, and a rear lateral forefoot part at a location substantially corresponding to a location of a head of the fifth metatarsal bone of the foot of the intended wearer when inside the shoe;

the shoe sole further comprising at least one rounded portion, each at least one rounded portion of the shoe sole comprising at least a concavely rounded portion of the outer surface of the shoe sole, as viewed in a shoe sole frontal plane cross-section during a shoe sole upright, unloaded condition, the concavity existing with respect to an inner section of the shoe sole directly adjacent to the concavely rounded outer surface portion;

each said at least one rounded portion of the shoe sole also comprising at least a concavely rounded portion of the inner surface of the shoe sole, as viewed in a shoe sole frontal plane cross-section during a shoe sole upright, unloaded condition, the concavity existing with respect to an intended wearer's foot location inside the shoe;

each at least one rounded portion of the shoe sole having a thickness that tapers from a greater thickness to a lesser thickness on a side of the rounded portion of the shoe sole, as viewed in both a shoe sole horizontal plane and a shoe sole frontal plane cross-section during a shoe sole upright, unloaded condition;

each said at least one rounded portion of the shoe sole comprises a midsole part;

one said rounded portion of the shoe sole being located at the lateral heel part and another said rounded portion of the shoe sole being located at the medial heel part;

at least an uppermost portion of an outer surface of each said at least one rounded portion of the shoe sole extending above a lowermost point of the sole inner surface, as viewed in a shoe sole frontal plane cross-section during a shoe sole upright, unloaded condition; and a heel portion thickness that is greater than a forefoot portion thickness as viewed in a shoe sole sagittal plane cross-section.

2. The shoe sole according to claim 1, wherein the concavely rounded outer surface portion of each said at least one rounded portion of the shoe sole extends down to near a lowest point of at least one of the lateral side and the medial side, as viewed in a shoe sole heel portion frontal plane cross-section during a shoe sole upright, unloaded condition.

3. The shoe sole according to claim 2, wherein said lateral heel part rounded portion of the shoe sole extends through a lowest point on the heel portion of the shoe sole, as viewed in a shoe sole frontal plane cross-section during a shoe sole upright, unloaded condition.

4. The shoe sole according to claim 2, wherein said medial heel part rounded portion of the shoe sole extends to at least a lowest point on the heel portion of the shoe sole, as viewed in a shoe sole frontal plane cross-section during a shoe sole upright, unloaded condition.

5. The shoe sole according to claim 1, wherein an outer surface of each said at least one rounded portion of the shoe sole is concavely rounded as viewed in a shoe sole horizontal plane during a shoe sole upright unloaded condition, the concavity existing with respect to an inner section of the shoe sole directly adjacent to the concavely rounded outer surface portion.

6. The shoe sole according to claim 5, wherein each said at least one rounded portion of the shoe sole has two sides and a thickness that tapers from a greater thickness to a lesser thickness on both sides of the rounded portion of the shoe sole, as viewed in a shoe sole horizontal plane during a shoe sole upright, unloaded condition.

7. The shoe sole according to claim 6, wherein each said at least one rounded portion of the shoe sole is oriented around and encompasses substantially all of said part at which a said rounded portion of the shoe sole is located, as viewed in a shoe sole horizontal plane during a shoe sole upright, unloaded condition.

8. The shoe sole according to claim 7, wherein the sole outer surface comprises a concavely rounded portion at a rearmost heel portion as viewed in a shoe sole sagittal plane cross-section during a shoe sole upright, unloaded condition, the concavity existing with respect to an inner section of the shoe sole directly adjacent to the concavely rounded outer surface portion; and the sole inner surface comprises a concavely rounded portion at a rearmost heel portion as viewed in a shoe sole sagittal plane during a shoe sole upright, unloaded condition, the concavity existing with respect to an intended wearer's foot location inside the shoe.

9. The shoe sole according to claim 7, wherein the sole outer surface includes a concavely rounded portion at a bottom of the heel portion, as viewed in a shoe sole sagittal plane cross-section during a shoe sole upright, unloaded condition, the concavity existing with respect to an inner section of the shoe sole directly adjacent to the concavely rounded outer surface portion.

10. The shoe sole according to claim 7, wherein a rearmost portion of one said at least one rounded portion of the shoe sole includes an upper section with a thickness that tapers from a greater thickness to a least thickness at an upper extent, as viewed in a shoe sole sagittal plane cross-section during a shoe sole upright, unloaded condition.

11. The shoe sole according to claim 7, further comprising a rounded portion of the shoe sole located at the rear lateral forefoot part.

12. The shoe sole according to claim 11, further comprising a rounded portion of the shoe sole located at the lateral midtarsal part.

13. The shoe sole according to claim 7, further comprising a rounded portion of the shoe sole located at the lateral midtarsal part.

14. The shoe sole according to claim 7, further comprising a rounded portion of the shoe sole located at the rear medial forefoot part.

15. The shoe sole according to claim 7, further comprising a rounded portion of the shoe sole located at the forward medial forefoot part.

16. The shoe sole according to claim 7, wherein the sole outer surface of the heel portion comprises a concavely rounded portion extending substantially continuously through the sole middle portion, as viewed in a shoe sole frontal plane cross-section during a shoe sole upright, unloaded condition, the concavity existing with respect to an inner section of the shoe sole directly adjacent to the concavely rounded outer surface portion; and the shoe sole inner surface comprises a concavely rounded portion extending substantially continuously through the sole middle portion, as viewed in a shoe sole frontal plane cross-section during a shoe sole upright, unloaded condition, the concavity existing with respect to an intended wearer's foot location inside the shoe.

17. The shoe sole according to claim 7, wherein the concavely rounded portion of the outer surface of each said at least one rounded portion of the shoe sole extends below a sidemost extent of its respective sole side, as viewed in a frontal plane cross-section when the shoe sole is in an upright, unloaded condition.

18. The shoe sole according to claim 7, wherein the outer surface of at least one said rounded portion of the shoe sole comprises a concavely rounded portion as viewed in a sagittal plane cross-section during a shoe sole upright, unloaded condition, the concavity existing with respect to an inner section of the shoe sole directly adjacent to the concavely rounded outer surface portion.

19. The shoe sole according to claim 18, wherein the sole inner surface of at least one said rounded portion of the shoe sole comprises a concavely rounded portion, as viewed in a sagittal plane cross-section during a shoe sole upright, unloaded condition, the concavity existing with respect to an intended wearer's foot location inside the shoe.

20. The shoe sole according to claim 19, wherein one said rounded portion of the shoe sole is located at the lateral heel part.

21. A shoe sole as claimed in claim 1, wherein at least a portion of the rounded portion shoe sole located between at least one said concavely rounded portion of the outer surface of the shoe sole and at least one said concavely rounded portion of the inner surface of the shoe sole has a substantially uniform thickness extending sufficiently provide direct load-bearing support between the sole of the foot and the ground through a sideways tilt of at least 30 degrees, as viewed in a frontal plane cross-section when the shoe sole is upright and in an unloaded condition.

22. A shoe sole as claimed in claim 21, wherein at least two of said rounded portions of the shoe sole, each located between one of said concavely rounded portion of the outer surface of the shoe sole and one said concavely rounded portion of the inner surface of the shoe sole, have a substantially uniform thickness extending sufficiently to provide direct load-bearing support between the sole of the foot and the ground through a sideways tilt of at least 30 degrees, as viewed in a frontal plane cross-section when the shoe sole is upright and in an unloaded condition.

23. A shoe sole as claimed in claim 22, wherein the substantially uniform thickness of the shoe sole is different when measured in at least two separate frontal plane cross-sections.

24. A shoe sole as claimed in claim 23, further comprising a concavely rounded portion of the sole outer surface extending substantially continuously through the sole middle portion of the sole heel portion, as viewed in shoe sole heel frontal plane cross-section during a shoe sole upright, unloaded condition, the concavity of the sole outer surface existing with respect to an inner section or the shoe sole directly adjacent to the concavely rounded outer surface portion, and a concavely rounded portion of the sole inner surface extending substantially continuously through the sole middle portion, as viewed in a shoe sole heel frontal plane cross-section during a shoe sole upright, unloaded condition, the concavity of the sole inner surface existing with respect to an intended wearer's foot location inside the shoe; and wherein a portion of the heel portion of the shoe sole located between said concavely rounded portion of the outer surface of the heel portion of the shoe sole and said concavely rounded portion of the inner surface of the heel portion of the shoe sole, has a substantially uniform thickness extending substantially continuously from a vertical line located at a lateral sidemost extent of the inner surface of the shoe sole to a vertical line located at a medial sidemost extent of the inner surface of the shoe sole, as viewed in a frontal plane cross-section when the shoe sole is upright and in an unloaded condition.

25. A shoe sole as claimed in claim 1, wherein at least a portion of at least one said rounded portion of the shoe sole located between at least one said concavely rounded portion of the outer surface of the shoe sole and one said concavely rounded portion of the inner surface of the shoe sole has a substantially uniform thickness extending substantially to a sidemost extent of the shoe sole side, as viewed in a frontal plane cross-section when the shoe sole is upright and in an unloaded condition.

26. A shoe sole as claimed in claim 25, wherein at least two of said rounded portions of the shoe sole, each located between at least one said concavely rounded portion of the outer surface of the shoe sole and one said concavely rounded portion of the inner surface of the shoe sole, have substantially uniform thickness extending substantially to a sidemost extent of the shoe sole side, as viewed in a frontal plane cross-section when the shoe sole is upright and in an unloaded condition.

27. A shoe sole as claimed in claim 26, wherein the substantially uniform thickness of the shoe sole is different when measured in at least two separate frontal plane cross-sections.

28. A sole as claimed in claim 1, further comprising a concavely rounded portion or the sole outer surface extending substantially continuously through the sole middle portion of the sole heel portion, as viewed in a shoe sole heel frontal plane cross-section during a shoe sole upright, unloaded condition, the concavity of the sole outer surface existing with respect to an inner section of the shoe sole directly adjacent to the concavely rounded outer surface portion, and a concavely rounded portion of the sole inner surface extending substantially continuously through the sole middle portion, as viewed in a shoe sole heel frontal plane cross-section during a shoe sole upright, unloaded condition, the concavity of the sole inner surface existing with respect to an intended wearer's foot location inside the shoe; and wherein a portion of the heel portion of the shoe sole located between said concavely rounded portion of the outer surface of the heel portion of the shoe sole and said concavely rounded portion of the inner surface of the heel portion of the shoe sole, has a substantially uniform thickness extending substantially continuously from a vertical line located at a lateral sidemost extent of the inner surface of the shoe sole to a vertical line located at medial sidemost extent of the inner surface of the shoe sole, as viewed in a frontal plane cross-section when the shoe sole is upright and in an uploaded condition.

29. A sole of a shoe, comprising:

a sole outer surface;

a sole inner surface for supporting a foot of an intended wearer when inside the shoe;

a heel portion at a location substantially corresponding to a location of a calcaneus bone of the foot of the intended wearer when inside the shoe;

a forefoot portion at a location substantially corresponding to a location of a forefoot of the foot of the intended wearer when inside the shoe;

a midtarsal portion located between the heel portion and the forefoot portion;

the sole heel, midtarsal and forefoot portions having a sole medial side, a sole lateral side, and a sole middle portion between the sole sides, at least a part of the sole outer surface of the sole middle portion having a tread pattern;

the sole lateral side and the sole medial side comprising a lowermost side section adjacent the sole middle portion, an intermediate side section above the lowermost side section, and an uppermost side section above the intermediate side section;

the heel portion having a lateral heel part at a location substantially corresponding to a location of a lateral tuberosity of the calcaneus bone of the foot of the intended wearer when inside the shoe, and a medial heel part at a location substantially corresponding to a location of a base of the calcaneus bone of the foot of the intended wearer when inside the shoe;

the midtarsal portion having a lateral midtarsal part at a location substantially corresponding to a location of a base of a fifth metatarsal bone of the foot of the intended wearer when inside the shoe;

the forefoot portion having a forward medial forefoot part at a location substantially corresponding to a location of a head of a first distal phalange bone, a rear medial forefoot part at a location substantially corresponding to a location of a head of a first metatarsal bone of the foot of the intended wearer when inside the shoe, and a rear lateral forefoot part at a location substantially corresponding to a location of a head of the fifth metatarsal bone of the foot of the intended wearer when inside the shoe;

the shoe sole further comprising at least one rounded portion, each at least one rounded portion of the shoe sole comprising at least a concavely rounded portion of the outer surface of the shoe sole, as viewed in a shoe sole frontal plane cross-section during a shoe sole upright, unloaded condition, the concavity existing with respect to an inner section of the shoe sole directly adjacent to the concavely rounded outer surface portion;

each said at least one rounded portion of the shoe sole also comprising at least a concavely rounded portion of the inner surface of the shoe sole, as viewed in a shoe sole frontal plane cross-section during a shoe sole upright, unloaded condition, the concavity existing with respect to an intended wearer's foot location inside the shoe;

each said at least one rounded portion of the shoe sole comprises a midsole part;

a rounded portion of the shoe sole being located at least at one of the lateral heel part and the medial heel part;

at least an uppermost portion of an outer surface of each at least one rounded portion of the shoe sole extends above a lowermost point of the sole inner surface, as viewed in a shoe sole frontal plane cross-section during a shoe sole upright, unloaded condition;

the sole outer surface at the heel portion comprises a concavely rounded portion extending substantially continuously through the sole middle portion, as viewed in a shoe sole heel frontal plane cross-section during a shoe sole upright, unloaded condition, the concavity existing with respect to an inner section of the shoe sole directly adjacent to the concavely rounded outer surface portion; and the sole inner surface at the heel portion comprises a concavely rounded portion extending substantially continuously through the sole middle portion, as viewed in a shoe sole heel frontal plane cross-section during a shoe sole upright, unloaded condition, the concavity existing with respect to an intended wearer's foot location inside the shoe;

said sole outer surface concavely rounded portion that extends substantially continuously through the sole middle portion of the sole heel portion having a radius of curvature greater than a maximum radial thickness of the sole middle portion, as viewed in a shoe sole heel frontal plane cross-section during a shoe sole upright, unloaded condition; and a heel portion thickness that is greater than a forefoot portion thickness as viewed in a shoe sole sagittal plane cross-section.

30. The shoe sole according to claim 29, wherein one said rounded portion of the shoe sole is located at both the lateral heel part and the medial heel part.

31. The shoe sole according to claim 30, wherein one said rounded portion of the shoe sole is located at the medial heel part.

32. A shoe sole as claimed in claim 29, wherein a portion of the heel portion of the shoe sole located between at least one said concavely rounded portion of the outer surface of the heel portion of the shoe sole and one said concavely rounded portion of the inner surface of the heel portion of the shoe sole has a substantially uniform thickness extending substantially continuously from a vertical line located at a lateral sidemost extent of the inner surface of the shoe sole to a vertical line located at a medial sidemost extent of the inner surface of the shoe sole, as viewed in a frontal plane cross-section when the slice sole is upright and in an unloaded condition.

33. A shoe sole as claimed in claim 32, wherein said rounded portion of the shoe sole has a substantially uniform thickness extending sufficiently to provide direct load-bearing support between the sole of the foot and the ground through a sideways tilt of at least 30 degrees, as viewed in a frontal plane a cross-section when the shoe sole is upright and in an unloaded condition.

34. A shoe sole as claimed in claim 33, wherein the shoe sole comprises at least two rounded portions of the shoe sole and at least two of said rounded portions of the shoe sole have a substantially uniform thickness extending sufficiently to provide direct load-bearing support between the sole of the foot and the ground through a sideways tilt of at least 30 degrees, as viewed in a frontal plane cross-section when the shoe sole is upright and in an unloaded condition.

35. A shoe sole as claimed in claim 34, wherein the substantially uniform thickness of the shoe sole is different when measured in at least two separate frontal plane cross-sections.

36. A shoe sole as claimed in claim 32, wherein at least a portion of at least one said rounded portion of the shoe sole located between at least one said concavely rounded portion of the outer surface of the shoe sole and one said concavely rounded portion of the inner surface of the shoe sole bus a substantially uniform thickness extending substantially to a sidemost extent of the shoe sole side, as viewed in a frontal plane cross-section when the shoe sole is upright and in an unloaded condition.

37. A shoe sole as claimed in claim 36, wherein at least two of said rounded portions of the shoe sole, each located between at least one said concavely rounded portion of the outer surface of the shoe sole and one said concavely rounded portion of the inner surface of the shoe sole, have a substantially uniform thickness extending substantially to a sidemost extent of the shoe sole side, as viewed in a frontal plane cross-section when the shoe sole is upright and in an loaded condition.

38. A shoe sole as claimed in claim 37, wherein the substantially uniform thickness of the shoe sole is different when measured in at least two separate frontal plane cross-sections.

* * * * *